US009442404B1

(12) United States Patent
Saito et al.

(10) Patent No.: US 9,442,404 B1
(45) Date of Patent: Sep. 13, 2016

(54) ELECTROSTATIC-IMAGE-DEVELOPING TONER, ELECTROSTATIC IMAGE DEVELOPER, AND TONER CARTRIDGE

(71) Applicant: FUJI XEROX CO., LTD., Tokyo (JP)

(72) Inventors: Yutaka Saito, Kanagawa (JP); Sakon Takahashi, Kanagawa (JP); Yasuaki Hashimoto, Kanagawa (JP); Tsutomu Furuta, Kanagawa (JP); Yuka Yamagishi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/933,755

(22) Filed: Nov. 5, 2015

(30) Foreign Application Priority Data

Jun. 2, 2015 (JP) ..... 2015-112397
Jun. 3, 2015 (JP) ..... 2015-113052

(51) Int. Cl.
*G03G 9/087* (2006.01)
*G03G 9/08* (2006.01)
*G03G 15/08* (2006.01)

(52) U.S. Cl.
CPC ..... *G03G 9/08755* (2013.01); *G03G 9/0819* (2013.01); *G03G 9/0827* (2013.01); *G03G 15/0865* (2013.01)

(58) Field of Classification Search
CPC ..... G03G 9/08755; G03G 9/0819; G03G 9/0827; G03G 9/08795; G03G 9/08797; G03G 15/0865
See application file for complete search history.

(56) References Cited

U.S. PATENT DOCUMENTS 5,853,942 A * 12/1998 Lin ..... G03G 9/081 430/137.1
2014/0308611 A1* 10/2014 Shimano ..... G03G 9/08755 430/109.4

FOREIGN PATENT DOCUMENTS

| | | | |
|---|---|---|---|
| JP | 2003098742 | A | 4/2003 |
| JP | 2003207942 | A | 7/2003 |
| JP | 2004126240 | A | 4/2004 |
| JP | 2009276641 | A | 11/2009 |
| JP | 2013-142877 | A | 7/2013 |
| JP | 2014106405 | A | 6/2014 |

* cited by examiner

*Primary Examiner* — Sandra Brase
(74) *Attorney, Agent, or Firm* — Oliff PLC

(57) ABSTRACT

There is provided an electrostatic-image-developing toner containing: a toner particle which contains a binder resin containing a polyester resin, a release agent, and a styrene (meth)acrylic resin and in which the styrene (meth)acrylic resin forms a domain having a number average diameter of 300 nm to 800 nm in the toner particle; and an inorganic particle in which the number average diameter of the domain is from 1.5 times to 10 times the number average particle diameter of the inorganic particle.

11 Claims, 2 Drawing Sheets

ELECTROSTATIC-IMAGE-DEVELOPING TONER, ELECTROSTATIC IMAGE DEVELOPER, AND TONER CARTRIDGE

CROSS-REFERENCE TO RELATED APPLICATIONS

This application is based on and claims priority under 35 USC 119 from Japanese Patent Application No. 2015-112397 filed on Jun. 2, 2015 and Japanese Patent Application No. 2015-113052 filed on Jun. 3, 2015.

BACKGROUND

1. Field

The present invention relates to an electrostatic-image-developing toner, an electrostatic image developer, and a toner cartridge.

2. Description of the Related Art

A method of visualizing image information through an electrostatic image, such as electrophotography, is currently used in various fields. In electrophotography, the image information is formed on a surface of an image holding member (photoreceptor) as an electrostatic image through charging and exposure processes, a toner image is developed on the surface of the photoreceptor using a developer containing a toner, and this toner image is visualized as an image through a transfer process of transferring the toner image to a recording medium such as a sheet and a fixing process of fixing the toner image onto a surface of the recording medium.

SUMMARY

[1] An electrostatic-image-developing toner containing:

a toner particle which contains a binder resin containing a polyester resin, a release agent, and a styrene (meth)acrylic resin and in which the styrene (meth)acrylic resin forms a domain having a number average diameter of 300 nm to 800 nm in the toner particle; and an inorganic particle in which the number average diameter of the domain is from 1.5 times to 10 times the number average particle diameter of the inorganic particle.

DESCRIPTION OF REFERENCE NUMERALS AND SIGNS

Figure 1:
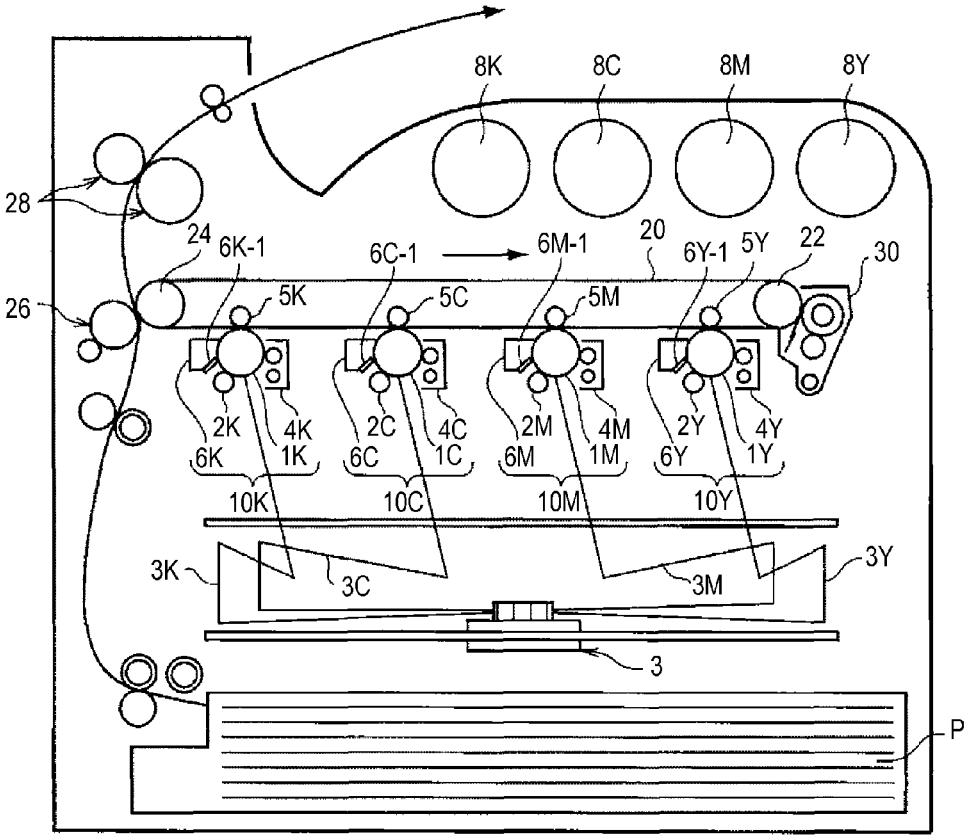
FIG. 1 is a schematic configuration diagram showing an example of an image forming apparatus according to the exemplary embodiment.

1Y, 1M, 1C, 1K Photoreceptor (an example of the image holding member)
2Y, 2M, 2C, 2K Charging roll (an example of the charging unit)
3 Exposure device (an example of the electrostatic image forming unit)
3Y, 3M, 3C, 3K Laser beam
4Y, 4M, 4C, 4K Developing device (an example of the developing unit)
5Y, 5M, 5C, 5K Primary transfer roll (an example of the primary transfer unit)

6Y, 6M, 6C, 6K Photoreceptor cleaning device (an example of the cleaning unit)
6Y-1, 6M-1, 6C-1, 6K-1 Cleaning blade
8Y, 8M, 8C, 8K Toner cartridge
10Y, 10M, 10C, 10K Image forming unit
20 Intermediate transfer belt (an example of the intermediate transfer body)
22 Driving roll
24 Support roll
26 Secondary transfer roll (an example of the secondary transfer unit)
30 Intermediate transfer member cleaning device
107 Photoreceptor (an example of the image holding member)
108 Charging roll (an example of the charging unit)
109 Exposure device (an example of the electrostatic image forming unit)
111 Developing device (an example of the developing unit)
112 Transfer device (an example of the transfer unit)
113 Photoreceptor cleaning device (an example of the cleaning unit)
115 Fixing device (an example of the fixing unit)
116 Mounting rail
117 Housing
118 Opening for exposure
200 Process cartridge
300 Recording sheet (an example of the recording medium)
P Recording sheet (an example of the recording medium)

DETAILED DESCRIPTION

Hereinafter, exemplary embodiments which are examples of the invention will be described in detail.

[Electrostatic-Image-Developing Toner]

At first, an electrostatic-image-developing toner according to the first exemplary embodiment is described.

An electrostatic-image-developing toner according to the first exemplary embodiment (hereinafter, referred to as a "toner") contains a toner particle which contains a binder resin containing a polyester resin, a release agent, and a styrene (meth)acrylic resin and in which the styrene (meth) acrylic resin forms a domain having a number average diameter of 300 nm to 800 nm in the toner particle, and an inorganic particle in which the number average diameter of the domain is from 1.5 times to 10 times the number average particle diameter of the inorganic particle. That is, the inorganic particle is an inorganic particle in which the number average diameter of the domain is from 1.5 times to 10 times the number average particle diameter of the inorganic particle.

Herein, the expression that the styrene (meth)acrylic resin forms a domain in the toner particles means a state where a sea-island structure in which the binder resin is set as a sea portion and the styrene (meth)acrylic resin is set as an island portion is formed. That is, the domain of the styrene (meth) acrylic resin is the island portion of the sea-island structure.

According to the configuration described above, the toner according to the first exemplary embodiment obtains peeling properties of a fixed image from a fixing member and prevents stripe image defects due to cleaning failure when a low-density image (for example, an image having an image density equal to or smaller than 5%) is formed after continuously forming a high-density image (for example, an image having an image density equal to or greater than 90%) in the environment of a high temperature and high humidity (for example, a temperature of 28° C. and humidity of 85%) (for example, after continuously forming 100,000 or more sheets of high-density images). The reason thereof is not clear but the following are assumed.

When the binder resin which is a polyester resin and the release agent are contained in the toner particle, the peeling properties of a fixed image from a fixing member such as a fixing roller may be decreased due to a flexible polyester resin. Meanwhile, when the styrene (meth)acrylic resin is further mixed with the toner particle, the styrene (meth) acrylic resin is set as a domain and a sea-island structure in which the binder resin is set as a sea portion and the styrene (meth)acrylic resin is set as an island portion in the toner particle is formed, because compatibility between the polyester resin and the styrene (meth)acrylic resin is low. In addition, since affinity between the styrene (meth)acrylic resin and the release agent is high, domains thereof easily approach each other in the toner particle. Accordingly, since the release agent is disposed around the domain portion of the styrene (meth)acrylic resin which is the island portion, dispersiveness of the release agent is improved. Further, the peeling properties of a fixed image from a fixing member such as a fixing roll are improved and fixing properties are improved.

Meanwhile, when a domain diameter of the styrene (meth)acrylic resin is equal to or smaller than 300 nm, the release agent contains domains of the plurality of styrene (meth)acrylic resins (hereinafter, also referred to as a "styrene (meth)acrylic domain" and aggregates of the styrene (meth)acrylic domain may be formed in the toner. Accordingly, the diameter of the styrene (meth)acrylic domain is apparently increased and dispersion of the release agent is hardly improved. In addition, when the diameter of the styrene (meth)acrylic domain is equal to or greater than 800 nm, a diameter of the domain of the release agent attached to the styrene (meth)acrylic domain is also increased and the dispersion of the release agent is hardly improved. Accordingly, it is preferable that the number average diameter (also referred to as average diameter) of the styrene (meth)acrylic domain is from 300 nm to 800 nm.

The number ratio of the domains having a diameter in a range of the average diameter ±100 nm among the domains of the styrene (meth)acrylic resin is preferably equal to or greater than 65%, and more preferably equal to or greater than 75%, in order to prevent a decrease in image density and fogging. By setting the number ratio of the domains to be equal to or greater than 65%, variation in distribution of domain diameter is reduced and the toner charging amount increase phenomenon due to dielectric polarization easily occurs. Accordingly, the toner charging amount increase phenomenon due to dielectric polarization and the toner charging amount decrease phenomenon due to oil are stably offset by each other. Therefore, the generation of a decrease in image density occurring when a low-density image is repeatedly printed in the environment of a high temperature and high humidity and the generation of fogging occurring in the environment of a high temperature and high humidity are both prevented.

However, when a low-density image is formed after a high-density image is formed for a long period of time in the environment of a high temperature and high humidity, using a toner (toner in which the number average diameter of styrene (meth)acrylic domain is from 300 nm to 800 nm) having the configuration as described above and excellent peeling properties, stripe image defects may occur.

Specifically, when strong stress is applied to the toner particles in a cleaning blade portion (contact region of an image holding member and a cleaning blade), the toner particle is cracked in a boundary portion between the binder resin and the styrene (meth)acrylic resin and the styrene (meth)acrylic domain is isolated as a particle. When the particle of the isolated styrene (meth)acrylic resin (hereinafter, also referred to as a "isolated styrene (meth)acrylic resin particle") remains on the cleaning blade portion, an externally-added dam (dam which is formed by accumulating the external additive isolated from the toner in the cleaning portion) may be broken and a charging member may be contaminated due to leakage of the external additive which has been prevented by the externally-added dam.

That is, by continuously forming a high-density image in the environment of a high temperature and high humidity, the number of the isolated styrene (meth)acrylic resin particles remaining in the cleaning blade portion increases and the externally-added dam is easily broken. When the externally-added dam is broken, the external additive is leaked from the cleaning blade, fixation (filming) to the image holding member or contamination of the charging member occurs, and when a low-density image is formed in that state, stripe image defects may easily occur.

With respect to this, when using the inorganic particle in which the number average diameter of the styrene (meth) acrylic domain is from 1.5 times to 10 times the number average particle diameter of the inorganic particle, as the external additive, the leakage of the external additive due to the breaking of the externally-added dam is prevented. Hereinafter, the inorganic particle in which the number average diameter of the styrene (meth)acrylic domain is from 1.5 times to 10 times the number average particle diameter of the inorganic particle may be referred to as "a specified inorganic particle".

When the number average diameter of the styrene (meth) acrylic domain is from 1.5 times to 10 times the number average particle diameter of the inorganic particle, a number average particle diameter of the isolated styrene (meth) acrylic resin particles also become 1.5 times to 10 times the number average particle diameter of the inorganic particle.

When strong stress is applied to the toner particles in the cleaning blade, the isolated styrene (meth)acrylic resin particles having the number average particle diameter which is suppressed to be from 300 nm to 800 nm, form a cleaning dam in which particles are classified by a diameter with the inorganic particles which is the isolated external additive. That is, the cleaning dam is particle-diameter-classified and is filled from the distal end (area close to a contact point between the image holding member and the cleaning blade among the cleaning blade portion) of a blade nip from the particle having a small particle diameter.

At that time, the release agent having high compatibility with the isolated styrene (meth)acrylic resin particles is attached to the surface of the isolated styrene (meth)acrylic resin particles and a non-electrostatic attachment force with the isolated styrene (meth)acrylic resin particles is increased. Accordingly, particularly, when a ratio between the particle diameter of the isolated styrene (meth)acrylic resin particle and the particle diameter of the inorganic particle is in the range described above, the inorganic particles are easily externally added to the isolated styrene (meth)acrylic resin particle. By externally adding the inorganic particles to the isolated styrene (meth)acrylic resin particle, fluidity of the isolated styrene (meth)acrylic resin particle is improved and the generation of isolated styrene (meth)acrylic resin particles remaining in the cleaning blade portion are prevented. Accordingly, the leakage of the external additive due to the breaking of the externally-added dam is prevented and generation of color stripes in the environment of a high temperature and high humidity is prevented.

When the number average diameter of the styrene (meth) acrylic domain is equal to or greater than 10 times the number average particle diameter of the inorganic particle, the diameter of the inorganic particle is relatively excessively small, and therefore, the inorganic particles are buried in the isolated styrene (meth)acrylic resin particles and are hardly supplied to the distal end of the blade nip. Accordingly, the externally-added dam in which particles are classified by a diameter is hardly formed and cleaning properties are decreased.

In addition, when the number average diameter of the styrene (meth)acrylic domain is equal to or smaller than 1.5 times the number average particle diameter of the inorganic particle, a difference in the particle diameters between the isolated styrene (meth)acrylic resin particles and the inorganic particles is excessively small, and therefore, the externally-added dam in which particles are classified by a diameter is hardly formed and cleaning properties are decreased.

As described above, in the first exemplary embodiment, it is assumed that the peeling properties are obtained and the stripe image defects are prevented.

The number average diameter of the styrene (meth)acrylic domain is preferably from 320 nm to 700 nm and more preferably from 350 nm to 600 nm, in order to improve the peeling properties and prevent stripe image defects due to cleaning failure.

In addition, the number average diameter of the styrene (meth)acrylic domain is preferably from 2 times to 9 times, or more preferably from 3 times to 8 times the number average particle diameter of the inorganic particle (specified inorganic particle), in order to improve the peeling properties and prevent stripe image defects due to cleaning failure.

In the first exemplary embodiment, the number average particle diameter of the specified inorganic particle is preferably from 15 nm to 200 nm.

When the number average particle diameter of the specified inorganic particle is from 15 nm to 200 nm, a stable externally-added dam is easily formed and the stripe image defects are further prevented. When the number average particle diameter of the specified inorganic particles is equal to or greater than 15 nm, the inorganic particles are easily isolated from the toner particles and are hardly transferred from the image holding member, compared to a case where the number average diameter thereof is smaller than 15 nm. Accordingly, an amount of the inorganic particles supplied to the cleaning blade is ensured and the stable externally-added dam is easily formed. When the number average particle diameter of the specified inorganic particles is equal to or smaller than 200 nm, the leakage of the inorganic particles to the cleaning blade portion is prevented and a stable externally-added dam is easily formed, compared to a case where the number average particle diameter thereof is greater than 200 nm.

In addition, the number average particle diameter of the specified inorganic particles is, more preferably from 80 nm to 200 nm, more preferably from 80 nm to 180 nm, more preferably from 90 nm to 180 nm and even more preferably from 100 nm to 140 nm.

Hereinafter, a measuring method of the number average diameter of the styrene (meth)acrylic domains and the number average particle diameter of the inorganic particles will be described.

Preparation and observation of a sample for measurement of the number average diameter of the domains are performed by the following method.

A toner is mixed with and buried in an epoxy resin and the epoxy resin is solidified. The obtained solidified material is cut with an ultramicrotome device (Ultracut UCT manufactured by Leica), and a thin-sliced sample having a thickness of 80 nm to 130 nm is prepared. Next, the obtained thin-sliced sample is dyed with ruthenium tetroxide in a desiccator at 30° C. for 3 hours.

Then, an SEM image of the dyed thin-sliced sample is obtained using an ultrahigh-resolution field-emission scanning electron microscope (FE-SEM, S-4800 manufactured by Hitachi High-Technologies Corporation). Since the release agent, the styrene (meth)acrylic resin, and the polyester resin are easily dyed with ruthenium tetroxide in this order, each component is identified by shading caused by a degree of dyeing. In a case where the shading is difficult to be determined due to the state of the sample, the dyeing time may be adjusted.

In the cross section of the toner particle, since the domain of the coloring agent is smaller than the domain of the release agent and the domain of the styrene (meth)acrylic resin, they may be differentiated according to the size.

The number average diameter of the styrene (meth)acrylic domains is measured by the following method.

In the SEM image, 30 cross sections of the toner particle having a maximum length which is 85% or more of a volume average particle diameter of the toner particle are selected, and 100 dyed styrene (meth)acrylic domains are observed. The maximum length of each domain is measured, the maximum length is assumed as a diameter of the domain, and the arithmetic average (number average) is set as the number average diameter of the domain.

The reason for selecting the cross section of the toner particle having a maximum length which is 85% or more of a volume average particle diameter of the toner particle is as follows. Since the toner is a three-dimensional shape and the SEM image is a cross section, the end portion may be cut and the cross section of the end portion does not reflect the domain in the toner particle.

The number average diameter of the styrene (meth)acrylic domain is controlled by a method of preparing the toner particle by aggregation and coalescence and adjusting a number average particle diameter of resin particles contained in a styrene (meth)acrylic resin particle dispersion liquid used at the time of the preparation; a method of preparing plural styrene (meth)acrylic resin particle dispersion liquids having different number average particle diameters and using the combination thereof; or the like, for example.

Measurement of the number average particle diameter of the inorganic particles contained in the toner is performed by the following method.

First, the toner is dispersed in an aqueous solution having 0.2% by mass of polyoxyethylene (10) octylphenyl ether to have a content of 10% by mass, and ultrasonic vibration (frequency of 20 kHz and output of 30 W) is operated using an ultrasonic homogenizer (US-300T manufactured by NISSEI Corporation) for 60 minutes while maintaining a temperature equal to or lower than 30° C., to separate the toner particles and the external additive. After that, only the inorganic particles are extracted by a filtering process and a washing process.

Regarding the extracted inorganic particles, particle size distribution is measured using a laser diffraction-type particle size distribution measuring device (for example, LS13

320 manufactured by Beckman Coulter, Inc.) and a number average particle diameter of each peak of the particle size distribution is acquired. That is, when the particle size distribution has a plurality of peaks, it is assumed that plural kinds of inorganic particles are used in combination, and a number average particle diameter of each of the plural kinds of inorganic particles is calculated by analyzing each peak. In the calculation of the number average particle diameter, cumulative distribution by number is drawn from the side of the smallest diameter of each peak with respect to separated particle size ranges (channels), and the particle diameter when the cumulative percentage becomes 50% with respect to all the particles of each peak is set as a number average particle diameter of the corresponding inorganic particle.

Hereinafter, a toner according to the first exemplary embodiment will be described in detail.

The toner according to the first exemplary embodiment contains the toner particle and the specified inorganic particle, and may contain other components, if necessary.

(Toner Particle)

The toner particle contains a binder resin containing a polyester resin, a release agent, and a styrene (meth)acrylic resin. The toner particle may contain other internal additives such as a coloring agent.

The toner particle has a sea-island structure in which the release agent and the styrene (meth)acrylic resin are dispersed in the binder resin containing the polyester resin, for example.

Binder Resin

As the binder resin, a polyester resin is used from a viewpoint of fixing properties. A rate of the polyester resin with respect to the entire binder resin may be equal to or greater than 85% by mass, is preferably equal to or greater than 95% by mass, and more preferably 100% by mass.

A well-known polyester resin is used, for example, as the polyester resin.

Examples of the polyester resin include condensation polymers of polyvalent carboxylic acids and polyols. A commercially available product or a synthesized product may be used as the polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with a diol. Examples of the tri- or higher-valent polyol include glycerin, trimethylolpropane, and pentaerythritol.

The polyols may be used alone or in combination of two or more kinds thereof.

The glass transition temperature (Tg) of the polyester resin is preferably from 50° C. to 80° C., and more preferably from 50° C. to 65° C.

The glass transition temperature is acquired by a DSC curve obtained by differential scanning calorimetry (DSC), and more specifically, is acquired by "extrapolation glass transition starting temperature" disclosed in a method of acquiring the glass transition temperature of JIS K7121-1987 "Testing Methods for Transition Temperature of Plastics".

The weight-average molecular weight (Mw) of the polyester resin is preferably from 5,000 to 1,000,000, and more preferably from 7,000 to 500,000.

The number-average molecular weight (Mn) of the polyester resin is preferably from 2,000 to 100,000.

The molecular weight distribution Mw/Mn of the polyester resin is preferably from 1.5 to 100, and more preferably from 2 to 60.

The weight-average molecular weight and the number-average molecular weight are measured by gel permeation chromatography (GPC). The molecular weight measurement by GPC is performed with a THF solvent using HLC-8120 GPC, GPC manufactured by Tosoh Corporation as a measurement device and using TSKgel Super HM-M (15 cm), a column manufactured by Tosoh Corporation. The weight-average molecular weight and the number-average molecular weight are calculated using a calibration curve of molecular weight created with a monodisperse polystyrene standard sample from results of this measurement.

The polyester resin can be obtained by a known manufacturing method. Specifically, it can be obtained by a method of conducting a reaction at a polymerization temperature set to 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

The content of the binder resin is, for example, preferably from 40% by mass to 90% by mass, more preferably from 50% by mass to 88% by mass, and even more preferably from 60% by mass to 85% by mass, with respect to the entirety of the toner particles.

As the binder resin, other binder resins may be used with the polyester resin.

Examples of the other binder resins include a vinyl resin formed of a homopolymer including monomers such as styrenes (for example, styrene, p-chlorostyrene, α-methyl styrene, or the like), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitriles (for example, acrylonitrile, methacrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), or a copolymer obtained by combining two or more kinds of these monomers (herein, excluding the styrene (meth)acrylic resin).

Examples of the other binder resins include a non-vinyl resin such as an epoxy resin, a polyester resin, a polyurethane resin, a polyamide resin, a cellulose resin, a polyether resin, and a modified rosin, a mixture of these and a vinyl resin, or a graft polymer obtained by polymerizing a vinyl monomer in the presence thereof.

These other binder resins may be used alone or in combination with two or more kinds thereof.

—Styrene (Meth)Acrylic Resin—

The styrene (meth)acrylic resin is a copolymer obtained by copolymerizing at least a monomer having a styrene structure and a monomer having a (meth)acrylic acid structure (monomer having an acryloyloxy group). "(Meth)acryl" is an expression including both "acryl" and "methacryl". That is, the "styrene (meth)acrylic resin" means at least one of a styrene acrylic resin and a styrene methacrylic resin.

Examples of the monomer having a styrene structure (hereinafter, referred to as a "styrene monomer") include styrene, alkyl substituted styrene (for example, α-methyl styrene, 2-methyl styrene, 3-methyl styrene, 4-methyl styrene, 2-ethyl styrene, 3-ethyl styrene, or 4-ethyl styrene), halogen substituted styrene (for example, 2-chlorostyrene, 3-chlorostyrene, or 4-chlorostyrene), and vinyl naphthalene. The styrene monomer may be used alone or in combination of two or more kinds thereof.

Among these, styrene is preferable as the styrene monomer, in viewpoints of ease of reaction, ease of controlling of the reaction, and availability.

Examples of the monomer having a (meth)acrylic acid structure (hereinafter, referred to as a "(meth)acrylic monomer") include (meth)acrylic acid and (meth)acrylic acid ester. Examples of (meth)acrylic acid ester include (meth) acrylic acid alkyl ester (for example, n-methyl (meth)acrylate, n-ethyl (meth)acrylate, n-propyl (meth)acrylate, n-butyl (meth)acrylate, n-pentyl (meth)acrylate, n-hexyl (meth) acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth)acrylate, isoheptyl (meth) acrylate, isooctyl (meth)acrylate, 2-ethylhexyl (meth) acrylate, cyclohexyl (meth)acrylate, or t-butylcyclohexyl (meth)acrylate), (meth)acrylic acid aryl ester (for example, phenyl (meth)acrylate, biphenyl (meth)acrylate, diphenylethyl (meth)acrylate, t-butylphenyl (meth)acrylate, or terphenyl (meth)acrylate), dimethylaminoethyl (meth)acrylate, diethylaminoethyl (meth)acrylate, methoxyethyl (meth) acrylate, 2-hydroxyethyl (meth)acrylate, 2-carboxyethyl (meth)acrylate, and (meth)acrylamide. The (meth)acrylic acid monomer may be used alone or in combination of two or more kinds thereof.

A copolymerization ratio of the styrene monomer and the (meth)acrylic monomer (styrene monomer/(meth)acrylic monomer based on weight), preferably from 85/15 to 70/30, for example.

The styrene (meth)acrylic resin preferably has a crosslinked structure, in order to prevent occurrence of a phenomenon in which a wave-like stripe image is formed when a high-density image is formed after a low-density image is formed in the environment of a high temperature and high humidity (hereinafter, also referred to as an aurora phenomenon). As the styrene (meth)acrylic resin having a crosslinked structure, a crosslinked material obtained by copolymerizing and crosslinking at least the monomer having a styrene structure, the monomer having a (meth)acrylic acid structure, and a crosslinking monomer, for example.

Examples of the crosslinking monomer include a bi- or higher functional crosslinking agent.

Examples of the bifunctional crosslinking agent include divinyl benzene, divinyl naphthalene, a di(meth)acrylate compound (for example, diethylene glycol di(meth)acrylate, methylenebis (meth)acrylamide, decanediol diacrylate, or glycidyl (meth) acrylate), polyester type di(meth)acrylate, and 2-([1'-methylpropylidene amino] carboxyamino) ethyl methacrylate.

Examples of multifunctional crosslinking agent include a tri(meth)acrylate compound (for example, pentaerythritol tri(meth)acrylate, trimethylolethane tri(meth)acrylate, or trimethylolpropane tri(meth)acrylate), a tetra(meth)acrylate compound (for example, tetramethylolmethane tetra (meth) acrylate, or oligoester (meth) acrylate), 2,2-bis (4-methacryloxy, polyethoxy phenyl) propane, diallyl phthalate, triallyl cyanurate, triallyl asocyanurate, triallyl isocyanurate, triallyl trimellitate, and diaryl chlorendate.

A copolymerization ratio of the crosslinking monomer with respect to the entirety of monomers (crosslinking monomer/entirety of monomer based on mass) is, preferably from 2/1000 to 30/1000, for example.

A weight-average molecular weight of the styrene (meth) acrylic resin is, for example, from 30,000 to 200,000, preferably from 40,000 to 100,000, and more preferably from 50,000 to 80,000, in order to prevent occurrence of the aurora phenomenon.

The weight-average molecular weight of the styrene (meth)acrylic resin particles is a value measured by the same method as that used for measuring the weight-average molecular weight of the polyester resin.

The content of the styrene (meth)acrylic resin is, for example, from 10% by mass to 30% by mass, more preferably from 12% by mass to 28% by mass, and even more preferably from 15% by mass to 25% by mass, with respect to the toner particle, in order to achieve fluidity and a storage property of the toner and to prevent occurrence of the aurora phenomenon.

—Release Agent—

Examples of the release agent include, hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

As the release agent, hydrocarbon wax is more preferable, in order to improve peeling properties and prevent stripe image defects due to cleaning failure.

The hydrocarbon wax is wax having hydrocarbon as a structure, and examples thereof include Fischer-Tropsch wax, polyethylene wax (wax having a polyethylene structure), polypropylene wax (wax having a polypropylene structure) paraffin wax (wax having a paraffin structure), and microcrystalline wax. Among these, Fischer-Tropsch wax is preferable as the hydrocarbon wax, in order to improve peeling properties and prevent stripe image defects due to cleaning failure.

The melting temperature of the release agent is preferably from 50° C. to 110° C., and more preferably from 60° C. to 100° C.

The melting temperature is obtained from "melting peak temperature" described in the method of obtaining a melting temperature in JIS K7121-1987 "testing methods for transition temperatures of plastics", from a DSC curve obtained by differential scanning calorimetry (DSC).

The content of the release agent is, for example, preferably from 1% by mass to 20% by mass, and more preferably from 5% by mass to 15% by mass with respect to the entirety of the toner particles.

—Colorant—

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination of two or more kinds thereof

If necessary, the colorant may be surface-treated or used in combination with a dispersing agent. Plural kinds of colorants may be used in combination.

The content of the colorant is, for example, preferably from 1% by mass to 30% by mass, and more preferably from 3% by mass to 15% by mass, with respect to the entirety of the toner particles.

—Other Additives—

Examples of other additives include known additives such as a magnetic material, a charge controlling agent, and an inorganic powder. The toner particles contain these additives as internal additives.

—Characteristics of Toner Particle—

The toner particles may be toner particles having a single-layer structure, or toner particles having a so-called core/shell structure composed of a core (core particle) and a coating layer (shell layer) coated on the core.

Here, toner particles having a core/shell structure is preferably composed of, for example, a core containing a binder resin and a styrene (meth)acrylic resin, and if necessary, other additives such as a coloring agent and a release agent and a coating layer containing a binder resin.

The volume average particle diameter (D50v) of the toner particles is preferably from 2 μm to 10 μm, and more preferably from 4 μm to 8 μm.

Various average particle diameters and various particle size distribution indices of the toner particles are measured using a Coulter Multisizer II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for 1 minute, and a particle size distribution of particles having a particle diameter of 2 μm to 60 μm is measured by a Coulter Multisizer II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume average particle diameter D16v and a number-average particle diameter D16p, while the particle diameter when the cumulative percentage becomes 50% is defined as that corresponding to a volume average particle diameter D50v and a number-average particle diameter D50p. Furthermore, the particle diameter when the cumulative percentage becomes 84% is defined as that corresponding to a volume average particle diameter D84v and a number-average particle diameter D84p.

Using these, a volume average particle size distribution index (GSDv) is calculated as $(D84v/D16v)^{1/2}$, while a number-average particle size distribution index (GSDp) is calculated as $(D84p/D16p)^{1/2}$.

The shape factor SF1 of the toner particles is preferably from 110 to 150, and more preferably from 120 to 140.

The shape factor SF1 is obtained through the following expression.

$$SF1=(ML^2/A)\times(\pi/4)\times 100 \quad \text{Expression}$$

In the foregoing expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and is calculated as follows. That is, an optical microscopic image of particles scattered on a surface of a glass slide is input to an image analyzer Luzex through a video camera to obtain maximum lengths and projected areas of 100 particles, values of SF1 are calculated through the foregoing expression, and an average value thereof is obtained.

(Specified Inorganic Particle)

The specified inorganic particle is not particularly limited as long as it is an inorganic particle in which the ratio between the number average diameter of the styrene (meth) acrylic domain and the number average particle diameter of the specified inorganic particles is in the range described above.

Examples of the specified inorganic particles include $SiO_2$, $TiO_2$, $Al_2O_3$, CuO, ZnO, $SnO_2$, $CeO_2$, $Fe_2O_3$, MgO, BaO, $CaO.SiO_2$, $Na_2O$, $ZrO_2$, $CaO.SiO_2$, $K_2O$—$(TiO_2)_n$, $Al_2O_3.2SiO_2$, $CaCO_3$, $MgCO_3$, $BaSO_4$, and $MgSO_4$.

The specified inorganic particles are preferably $SiO_2$ and $TiO_2$, and more preferably $SiO_2$, in order to improve the peeling properties and prevent stripe image defects due to cleaning failure.

A Surface of the specified inorganic particle may be subjected to a hydrophobizing treatment. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof. The amount of the hydrophobizing agent is, for example, from 1 part by mass to 10 parts by mass, with respect to 100 parts by weight of the inorganic particles.

The inorganic particle is preferably an oil-treated silica particle having an oil isolation amount of 3% by mass to 30% by mass.

In the first exemplary embodiment, the oil-treated silica particle is same as the oil-treated silica particle in the external additive described in the second exemplary embodiment as described later.

The content of the specified inorganic particle is, for example, preferably from 0.01% by mass to 5% by mass, and more preferably from 0.01% by mass to 2.0% by mass, with respect to the amount of the toner particles.

—Other External Additives—

The toner of the first exemplary embodiment may contain external additives other than the specified inorganic particles. Examples of other external additives may include inorganic particles having a smaller number average particle diameter than that of the specified inorganic particles, inorganic particles having a greater number average particle diameter than that of the specified inorganic particles, resin particles (resin particles such as polystyrene, PMMA, and melamine resin), and a cleaning activator (for example, metal salt of a higher fatty acid represented by zinc stearate, and fluorine polymer particles).

(Toner Preparing Method)

The toner particles are prepared and the toner particles may be set as the toner according to the first exemplary embodiment, and the external additive is externally added to the toner particle and this may be set as the toner.

The toner particles may be prepared using any of a dry preparing method (e.g., kneading and pulverizing method) and a wet preparing method (e.g., aggregation and coalescence method, suspension and polymerization method, and dissolution and suspension method). The toner particle preparing method is not particularly limited to these preparing methods, and a known preparing method is employed.

Among these, the toner particles are preferably obtained by an aggregation and coalescence method.

Specifically, for example, when the toner particles are prepared by an aggregation and coalescence method, the toner particles are prepared through the processes of: preparing a polyester resin particle dispersion liquid in which polyester resin particles are dispersed (polyester resin particle dispersion liquid preparation process); preparing styrene (meth)acrylic resin particle dispersion liquid in which styrene (meth)acrylic resin particles are dispersed (styrene (meth)acrylic resin particle dispersion liquid preparation process); preparing a release agent dispersion liquid in which release agent particles are dispersed (release agent dispersion liquid preparation process); aggregating resin particles and the release agent particles (and other particles, if necessary) in a mixed dispersion liquid obtained by mixing the two resin particle dispersion liquid and the release agent dispersion liquid with each other (in dispersion liquid obtained by mixing the other particle dispersion liquid such as a coloring agent, too, if necessary) and forming first aggregated particles (first aggregated particle forming process); mixing the first aggregated particle dispersion liquid in which the first aggregated particles are dispersed, and the polyester resin particle dispersion liquid with each other, performing aggregation so as to adhere the polyester resin particles to the surface of the first aggregated particles and forming the second aggregated particles (second aggregated particle forming process); and heating the second aggregated particle dispersion liquid in which the second aggregated particles are dispersed, to coalesce the second aggregated particles, and forming toner particles (coalescence process).

In addition, the toner particles may be prepared through the processes of: heating the first aggregated particle dispersion liquid in which the first aggregated particles are dispersed, to coalesce the first aggregated particles, and forming toner particles, without performing the second aggregated particle forming process.

Hereinafter, the respective processes will be described in detail.

In the following description, a method of obtaining toner particles containing a coloring agent will be described, but the coloring agent is only used if necessary. Additives other than the coloring agent may also be used.

—Resin Particle Dispersion liquid Preparation Process—

First, with the resin particle dispersion liquid in which the polyester resin particles to be the binder resin are dispersed, a styrene (meth)acrylic resin particle dispersion liquid in which the styrene (meth)acrylic resin particles are dispersed, a coloring agent dispersion liquid in which the coloring agent particles are dispersed, and a release agent dispersion liquid in which release agent particles are dispersed are prepared.

The polyester resin particle dispersion liquid is prepared by, for example, dispersing the polyester resin particles by a surfactant in a dispersion medium.

Examples of the dispersion medium used for the polyester resin particle dispersion include aqueous mediums.

Examples of the aqueous mediums include water such as distilled water and ion exchange water, and alcohols. These may be used alone or in combination of two or more kinds thereof.

Examples of the surfactant include anionic surfactants such as sulfuric ester salt, sulfonate, phosphate, and soap; cationic surfactants such as amine salt and quaternary ammonium salt; and nonionic surfactants such as polyethylene glycol, alkyl phenol ethylene oxide adduct, and polyol. Among these, anionic surfactants and cationic surfactants are particularly used. Nonionic surfactants may be used in combination with anionic surfactants or cationic surfactants.

The surfactants may be used alone or in combination of two or more kinds thereof.

As a method of dispersing the polyester resin particles in the dispersion medium, a common dispersing method using, for example, polyester resin particles in the dispersion medium, a common dispersing method using, for example, a rotary shearing-type homogenizer, or a ball mill, a sand mill, or a Dyno Mill having media is exemplified. In addition, the polyester resin particles may be dispersed in the dispersion medium using, for example, a phase inversion emulsification method. The phase inversion emulsification method includes: dissolving a resin to be dispersed in a hydrophobic organic solvent in which the resin is soluble; performing neutralization by adding a base to an organic continuous phase (0 phase); and performing phase inversion from W/O to O/W by adding water (W phase), thereby dispersing the resin as particles in the aqueous medium.

The volume average particle diameter of the polyester resin particles dispersed in the polyester resin particle dispersion liquid is, for example, preferably from 0.01 μm to 1 μm, more preferably from 0.08 μm to 0.8 μm, and even more preferably from 0.1 μm to 0.6 μm.

Regarding the volume average particle diameter of the polyester resin particles, a cumulative distribution by volume is drawn from the side of the smallest diameter with respect to particle size ranges (channels) separated using the particle size distribution obtained by the measurement of a laser diffraction-type particle size distribution measuring device (for example, manufactured by Horiba, Ltd., LA-700), and a particle diameter when the cumulative percentage becomes 50% with respect to the entirety of the particles is measured as a volume average particle diameter D50v. The volume average particle diameter of the particles in other dispersion liquid is also measured in the same manner.

The content of the polyester resin particles contained in the polyester resin particle dispersion liquid is, for example, preferably from 5% by mass to 50% by mass, and more preferably from 10% by mass to 40% by mass.

The styrene (meth)acrylic resin particle dispersion liquid, the coloring agent dispersion liquid, and the release agent dispersion liquid are also prepared in the same manner as in the case of the polyester resin particle dispersion liquid. That is, the polyester resin particle dispersion liquid is the same as the styrene (meth)acrylic resin particle dispersion liquid, the coloring agent dispersion liquid, and the release agent dispersion liquid, in terms of the dispersion medium, the dispersing method, the volume average particle diameter of the particles, and the content of the particles.

—First Aggregated Particle Forming Process—

Next, the polyester resin particle dispersion liquid, the styrene (meth)acrylic resin particle dispersion liquid, the coloring agent dispersion liquid, and release agent dispersion liquid are mixed with each other.

The polyester resin particles, the styrene (meth)acrylic resin particles, the coloring agent particles, and the release agent particles heterogeneously aggregate in the mixed dispersion liquid, thereby forming first aggregated particles having a diameter near a target toner particle diameter and including the polyester resin particles, the styrene (meth) acrylic resin particles, the coloring agent particles, and the release agent particles.

Specifically, for example, an aggregating agent is added to the mixed dispersion liquid and a pH of the mixed dispersion liquid is adjusted to acidity (for example, the pH is from 2 to 5). If necessary, a dispersion stabilizer is added. Then, the mixed dispersion liquid is heated at a temperature of the glass transition temperature of the polyester resin (specifically, for example, from a temperature 30° C. lower than the glass transition temperature of the polyester resin particles to a temperature 10° C. lower than the glass transition temperature) to aggregate the particles dispersed in the mixed dispersion liquid, thereby forming the first aggregated particles.

In the first aggregated particle forming process, for example, the aggregating agent may be added at room temperature (for example, 25° C.) under stirring of the mixed dispersion liquid using a rotary shearing-type homogenizer, the pH of the mixed dispersion liquid may be adjusted to acidity (for example, the pH is from 2 to 5), a dispersion stabilizer may be added if necessary, and the heating may then be performed.

As the aggregating agent, a surfactant having an opposite polarity to the polarity of the surfactant included in the mixed dispersion liquid, for example, inorganic metal salts and di- or higher-valent metal complexes are used. When a metal complex is used as the aggregating agent, the amount of the aggregating agent used is reduced and charging characteristics are improved.

With the aggregating agent, an additive may be used to form a complex or a similar bond with the metal ions of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid; aminocarboxylic acid such as iminodiacetic acid (IDA), nitrilotriacetic acid (NTA), and ethylenediaminetetraacetic acid (EDTA).

The amount of the chelating agent added is, for example, preferably from 0.01 parts by mass to 5.0 parts by mass, and more preferably from 0.1 parts by mass to less than 3.0 parts by mass, with respect to 100 parts by mass of the resin particles.

—Second Aggregated Particle Forming Process—

After obtaining the first aggregated particle dispersion liquid in which the first aggregated particles are dispersed, the first aggregated particle dispersion liquid and the polyester resin particle dispersion liquid are mixed with each other.

The release agent dispersion liquid may be mixed, if necessary, and the release agent particles may be contained in the second aggregated particles. In addition, the polyester resin particle dispersion liquid and the release agent dispersion liquid may be mixed with each other in advance, and this mixed solution may be mixed with the first aggregated particle dispersion liquid.

In the mixed dispersion liquid in which the first aggregated particles and the polyester resin particles are dispersed, the particles are aggregated so as to adhere the polyester resin particles to the surface of the first aggregated particles, and the second aggregated particles are formed.

Specifically, for example, in the first aggregated particle forming process, when the desired particle diameter of the first aggregated particles is achieved, the dispersion liquid in which the polyester resin particles are dispersed is mixed with the first aggregated particle dispersion liquid. Then, this mixed dispersion liquid is heated at a temperature equal to or lower than the glass transition temperature of the polyester resin. By setting the pH of the mixed dispersion liquid in a range of 6.5 to 8.5, for example, the progress of the aggregation is stopped.

Accordingly, the second aggregated particles are obtained by aggregating the polyester resin particles and the release agent particles so as to adhere the surface of the first aggregated particles.

—Coalescence Process—

Next, the second aggregated particle dispersion liquid in which the second aggregated particles are dispersed is heated at, for example, a temperature that is equal to or higher than the glass transition temperature of the polyester resin (for example, a temperature that is higher than the glass transition temperature of the polyester resin particles by 10° C. to 50° C.) to coalesce the second aggregated particles and form toner particles.

Toner particles are obtained through the foregoing processes.

After the coalescence process ends, the toner particles formed in the solution are subjected to a washing process, a solid-liquid separation process, and a drying process, that are well known, and thus dry toner particles are obtained.

In the washing process, preferably, displacement washing using ion exchange water is sufficiently performed from the viewpoint of charging properties. In addition, the solid-liquid separation process is not particularly limited, but suction filtration, pressure filtration, or the like is preferably performed from the viewpoint of productivity. The method for the drying process is also not particularly limited, but freeze drying, flash jet drying, fluidized drying, vibration-type fluidized drying, or the like is preferably performed from the viewpoint of productivity.

The toner according to the first exemplary embodiment is prepared by, for example, adding and mixing an external additive with dry toner particles that have been obtained. The mixing is preferably performed with, for example, a V-blender, a HENSCHEL mixer, a Lödige mixer, or the like. Furthermore, if necessary, coarse toner particles may be removed using a vibration sieving machine, a wind-power sieving machine, or the like.

Next, an electrostatic-image-developing toner according to the second exemplary embodiment is described as follows.

An electrostatic-image-developing toner according to the second exemplary embodiment (hereinafter, referred to as a "toner") includes a toner particle and an external additive.

The toner particle are a toner particle which contains a binder resin containing a polyester resin and a styrene (meth)acrylic resin and in which the styrene (meth)acrylic resin forms domains having an average diameter of 300 nm to 800 nm in the toner particles. Meanwhile, the external additive contains an oil-treated silica particle having an oil isolation amount of 3% by mass to 30% by mass.

Herein, the expression that the styrene (meth)acrylic resin forms a domain in the toner particles means a state where a sea-island structure in which the binder resin is set as a sea portion and the styrene (meth)acrylic resin is set as an island portion is formed. In a case of containing a release agent, the release agent also forms domains in the toner particles.

According to the configuration described above, the toner according to the second exemplary embodiment prevents generation of color stripes occurring in the environment of a high temperature and high humidity when a polyester resin is contained as a binder resin, a decrease in image density occurring when a low-density image is repeatedly printed in the environment of a high temperature and high humidity, and generation of fogging occurring in the environment of a high temperature and high humidity. For the reason thereof, the following are assumed.

First, when a polyester resin having sharp melting properties is contained in the toner particles as a binder resin, low temperature fixing properties of the toner are easily realized. However, since the polyester resin has flexible properties, the toner particles are easily crushed by a cleaning unit in the environment of a high temperature and high humidity (for example, in the environment of a temperature of 28° C. and humidity of 85%), the toner particles are attached to a surface of an image holding member (hereinafter, a phenomenon of attachment of the toner particles is also referred to as "filming"), and color stripes may be generated. Particularly, when a low-density image is repeatedly printed in the environment of a high temperature and high humidity, color stripes are easily generated.

Meanwhile, when the styrene (meth)acrylic resin is contained in the toner particle with the polyester resin as a binder resin, the styrene (meth)acrylic resin forms a domain, and accordingly, a filler effect (filling effect) is applied and strength of the toner particle is increased. Accordingly, the toner particles are hardly crushed and generation of color stripes due to the filming is prevented. However, when a low-density image (for example, an image having image density equal to or smaller than 5%) is repeatedly printed in the environment of a high temperature and high humidity (for example, in the environment of a temperature of 28° C. and humidity of 85%) and the toner particles continuously receive mechanical loads due to a stirring member or the like in a developing unit, dielectric polarization easily occurs in a boundary between the polyester resin and the styrene (meth)acrylic resin, in a structure where a domain of the styrene (meth)acrylic resin is formed in the polyester resin as a binder resin. When this dielectric polarization occurs, an excessive increase in a charging amount (charge-up) of the toner occurs, and a decrease in image density occurs due to a decrease in developing properties.

When the oil-treated silica particles are externally added to the toner particles containing the polyester resin as a binder resin, oil isolated from the oil-treated silica particles is applied to the surface of the image holding member and accordingly lubricity increases. However, when the isolation oil amount of the oil-treated silica particles is increased, in order to increase cleaning properties of the toner and prevent generation of color stripes due to filming, isolated oil attached to the surface of the toner particles (in a case of a two-component developer, also attached to a carrier) due to the stirring in the developing unit absorbs moisture in the environment of a high temperature and high humidity (for example, in the environment of a temperature of 28° C. and humidity of 85%), and this moisture-absorbed oil becomes a guide passage to cause charges charged to the toner particles to leak and to cause fogging (a phenomenon in which the toner is attached to a non-image portion) due to an excessive decrease in charging. Particularly, since resin resistance of the polyester resin is low, fogging due to a decrease in charging easily occurs.

As described above, when various technologies for preventing generation of color stripes occurring in the environment of a high temperature and high humidity when the polyester resin is contained as a binder resin, are employed, image density is decreased when a low-density image is repeatedly printed in the environment of a high temperature and high humidity, or fogging occurs in the environment of a high temperature and high humidity.

With respect to this, when the oil-treated silica particles are externally added to the toner particles containing a binder resin containing the polyester resin, and the styrene (meth)acrylic resin, a phenomenon in which a charging amount of the toner is increased due to dielectric polarization in a boundary between the polyester resin and the styrene (meth)acrylic resin (hereinafter, also referred to as "toner charging amount increase phenomenon due to dielectric polarization") and a phenomenon in which a charging amount of the toner is decreased due to moistures absorption of oil isolated from the oil-treated silica particles (hereinafter, also referred to as "toner charging amount decrease phenomenon due to oil") are offset by each other, and fluctuation in a charging amount of the toner due to any phenomenon is decreased.

Specifically, by setting an average diameter of the domain of the styrene (meth)acrylic resin in the range described above, the filling effect for the toner particles is ensured in order to prevent color stripes, an area of the boundary between the polyester resin and the styrene (meth)acrylic resin is ensured, and dielectric polarization in the boundary suitably occurs. Accordingly, since the generation of color stripes are prevented and the toner charging amount decrease phenomenon due to oil is offset by the toner charging amount increase phenomenon due to dielectric polarization, an excessive decrease in a charging amount of the toner occurring in the environment of a high temperature and high humidity due to external addition of the oil-treated silica particles is prevented.

Meanwhile, by setting the isolation oil amount of the oil-treated silica particles in the range described above, a decrease in a charging amount of the toner suitably occurs and lubricity of the surface of the image holding member increases in order to prevent color stripes. Accordingly, since the generation of color stripes are prevented and toner charging amount increase phenomenon due to dielectric polarization is offset by the toner charging amount decrease phenomenon due to oil, an excessive increase in a charging amount of the toner (charge-up) which is due to the styrene (meth)acrylic resin contained in the toner particles and occurs when a low-density image is repeatedly printed in the environment of a high temperature and high humidity is prevented.

That is, by setting an average diameter of the domains of the styrene (meth)acrylic resin and the isolation oil amount of the oil-treated silica particles in the range described above, the charging capability of the toner is suitably controlled and fluctuation in a charging amount of the toner is decreased, and accordingly, a decrease in image density occurring when a low-density image is repeatedly printed in the environment of a high temperature and high humidity and generation of fogging occurring in the environment of a high temperature and high humidity are both prevented.

The toner particles containing the styrene (meth)acrylic resin with the polyester resin as a binder resin has increased hardness, and therefore, aggregation of the toner particles hardly occur, even when the isolation oil amount of the oil-treated silica particles is increased.

Hereinabove, it is assumed that the toner according to the second exemplary embodiment prevents generation of stripes occurring in the environment of a high temperature and high humidity when the polyester resin is contained as a binder resin, a decrease in image density occurring when a low-density image is repeatedly printed in the environment of a high temperature and high humidity, and generation of fogging occurring in the environment of a high temperature and high humidity.

As a method of controlling the charging capability of the toner and decreasing fluctuation in a charging amount of the toner, a method using low-resistance titania particles as an external additive is also considered. However, the titania particles have high specific gravity, and it is necessary to increase an externally added amount in order to ensure sufficient toner charging controlling capability. Accordingly, developing properties due to charge injection are decreased due to a large amount of titania particles. As a result, image density is decreased.

Hereinafter, the toner according to the second exemplary embodiment will be described in detail.

The toner according to the exemplary embodiment may include a toner particle and an external additive which is externally added to the toner particle.

[Toner Particle]

The toner particle contains a binder resin and a styrene (meth)acrylic resin. The toner particle may contain other internal additives such as a coloring agent, or a release agent.

The toner particles, for example, have a sea-island structure in which the styrene (meth)acrylic resin is dispersed in the binder resin. In a case of containing the release agent, too, the toner particles have a sea-island structure in which the release agent is dispersed in the binder resin.

—Binder Resin—

In the second exemplary embodiment, the binder resin is same as the binder resin described in the first exemplary embodiment above.

The content of the binder resin is, for example, preferably from 40% by mass to 95% by mass, more preferably from 50% by mass to 90% by mass, and even more preferably from 60% by mass to 85% by mass, with respect to the entirety of toner particles.

—Styrene (Meth)Acrylic Resin—

The styrene (meth)acrylic resin is a copolymer obtained by at least copolymerizing a monomer having a styrene structure and a monomer having a (meth)acryloyloxy group. "(Meth)acrylic" is an expression including both of "acrylic acid" and "methacrylic acid". In addition, "(meth)acryloyloxy" is also an expression including both of "acryloyloxy" and "methacryloyloxy".

Examples of the monomer having a styrene structure (hereinafter, referred to as a "styrene monomer") include styrene, alkyl substituted styrene (for example, α-methyl styrene, 2-methyl styrene, 3-methyl styrene, 4-methyl styrene, 2-ethyl styrene, 3-ethyl styrene, or 4-ethyl styrene), halogen substituted styrene (for example, 2-chlorostyrene, 3-chlorostyrene, or 4-chlorostyrene), and vinyl naphthalene. The styrene monomer may be used alone or in combination of two or more kinds thereof.

Among these, styrene is preferable as the styrene monomer, in viewpoints of ease of reaction, ease of controlling of the reaction, and availability.

Examples of the monomer having a (meth)acryloyloxy group (hereinafter, referred to as a "(meth)acrylic monomer") include (meth)acrylic acid and (meth)acrylic acid ester. Examples of (meth)acrylic acid ester include (meth) acrylic acid alkyl ester (for example, n-methyl (meth)acrylate, n-ethyl (meth)acrylate, n-propyl (meth)acrylate, n-butyl (meth)acrylate, n-pentyl (meth)acrylate, n-hexyl (meth) acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth)acrylate, isoheptyl (meth) acrylate, isooctyl (meth)acrylate, 2-ethylhexyl (meth) acrylate, cyclohexyl (meth)acrylate, or t-butylcyclohexyl (meth)acrylate), (meth)acrylic acid aryl ester (for example, phenyl (meth)acrylate, biphenyl (meth)acrylate, diphenylethyl (meth)acrylate, t-butylphenyl (meth)acrylate, or terphenyl (meth)acrylate), dimethylaminoethyl (meth)acrylate, diethylaminoethyl (meth)acrylate, methoxyethyl (meth) acrylate, 2-hydroxyethyl (meth)acrylate, β-carboxyethyl (meth)acrylate, and (meth)acrylamide. The (meth)acrylic acid monomer may be used alone or in combination of two or more kinds thereof.

A copolymerization ratio of the styrene monomer and the (meth)acrylic monomer (styrene monomer/(meth)acrylic monomer based on mass) is, preferably from 85/15 to 70/30, for example.

The styrene (meth)acrylic resin preferably has a crosslinked structure, in order to prevent color stripes. As the styrene (meth)acrylic resin having a crosslinked structure, a crosslinked material obtained by copolymerizing and crosslinking at least the monomer having a styrene structure, the monomer having a (meth)acryloyloxy group, and a crosslinking monomer, for example.

Examples of the crosslinking monomer include a bi- or higher functional crosslinking agent.

Examples of the bifunctional crosslinking agent include divinyl benzene, divinyl naphthalene, a di(meth)acrylate compound (for example, diethylene glycol di(meth)acrylate, methylenebis (meth)acrylamide, decanediol diacrylate, or glycidyl (meth) acrylate), polyester type di(meth)acrylate, and 2-([1'-methylpropylidene amino] carboxyamino) ethyl methacrylate.

Examples of multifunctional crosslinking agent include a tri(meth)acrylate compound (for example, pentaerythritol tri(meth)acrylate, trimethylolethane tri(meth)acrylate, or trimethylolpropane tri(meth)acrylate), a tetra(meth)acrylate compound (for example, tetramethylolmethane tetra (meth) acrylate, or oligoester (meth) acrylate), 2,2-bis (4-methacryloxy, polyethoxy phenyl) propane, diallyl phthalate, triallyl cyanurate, triallyl asocyanurate, triallyl isocyanurate, triallyl trimellitate, and diaryl chlorendate.

A copolymerization ratio of the crosslinking monomer with respect to the entirety of monomers (crosslinking monomer/entirety of monomer based on mass) is, preferably from 2/1000 to 30/1000, for example.

An average diameter of the domains of the styrene (meth)acrylic resin is from 300 nm to 800 nm. This average diameter is preferably from 350 nm to 650 nm, and more preferably from 400 nm to 600 nm in order to prevent color stripes, a decrease in image density, and fogging.

By setting the average diameter of the domains to be equal to or greater than 300 nm, an excessive increase in the area of the boundary between the polyester resin and the styrene (meth)acrylic resin is prevented and generation of an excessive permittivity in the boundary. Accordingly, a decrease in image density due to charge-up is prevented.

Meanwhile, by setting the average diameter of the domains to be equal to or smaller than 800 nm, the toner charging amount increase phenomenon due to dielectric polarization suitably occurs. Accordingly, the generation of fogging due to a decrease in charging is prevented. In addition, by setting the average diameter of the domains to be equal to or smaller than 800 nm, a filling effect due to the domains of the styrene (meth)acrylic resin is ensured and the generation of filming due to crush of the toner particles is prevented. Therefore, the generation of color stripes is prevented.

The number ratio of the domains having a diameter in a range of the average diameter ±100 nm among the domains of the styrene (meth)acrylic resin is preferably equal to or greater than 65%, and more preferably equal to or greater than 75%, in order to prevent a decrease in image density and fogging. By setting the number ratio of the domains to be equal to or greater than 65%, variation in distribution of domain diameter is reduced and the toner charging amount increase phenomenon due to dielectric polarization easily occurs. Accordingly, the toner charging amount increase phenomenon due to dielectric polarization and the toner charging amount decrease phenomenon due to oil are stably offset by each other. Therefore, the generation of a decrease in image density occurring when a low-density image is repeatedly printed in the environment of a high temperature and high humidity and the generation of fogging occurring in the environment of a high temperature and high humidity are both prevented.

Hereinafter, a measuring method of the average diameter of the domains of the styrene (meth)acrylic resin will be described.

A sample for measurement and an image are prepared by the following method.

A toner is mixed with and buried in an epoxy resin and the epoxy resin is solidified. The obtained solidified material is cut with an ultramicrotome device (Ultracut UCT manufactured by Leica), and a thin-sliced sample having a thickness of 80 nm to 130 nm is prepared. Next, the obtained thin-sliced sample is dyed with ruthenium tetroxide in a desiccator at 30° C. for 3 hours. Then, an SEM image of the dyed thin-sliced sample is obtained using an ultrahigh-resolution field-emission scanning electron microscope (FE-SEM, S-4800 manufactured by Hitachi High-Technologies Corporation). Since the styrene (meth)acrylic resin and the polyester resin are easily dyed with ruthenium tetroxide in this order, each component is identified by shading caused by a degree of dyeing. In a case where the shading is difficult to be determined due to the state of the sample, the dyeing time may be adjusted.

In the cross section of the toner particle, since the domain of the coloring agent is smaller than the domain of the styrene (meth)acrylic resin, they may be differentiated according to the size.

The average diameter of the styrene (meth)acrylic domains is measured by the following method.

In the SEM image, 30 cross section of the toner particle having a maximum length which is 85% or more of a volume average particle diameter of the toner particle are selected, and 100 dyed styrene (meth)acrylic domains are observed. The maximum length of each domain is measured, the maximum length is assumed as a diameter of the domain, and the arithmetic average is set as the average diameter of the domain.

In addition, with the measured diameters of total 100 domains, the number ratio of the domains having a diameter in a range of the average diameter ±100 nm is determined.

The average diameter of the domain of the styrene (meth) acrylic resin and the distribution of the domain diameter are controlled by a method of preparing the toner particle by aggregation and coalescence and adjusting a volume average particle diameter of resin particles contained in a styrene (meth)acrylic resin particle dispersion used at the time of the preparing; a method of preparing plural styrene (meth) acrylic resin particle dispersions having different volume average particle diameters and using the combination thereof; or the like, for example.

A weight average molecular weight of the styrene (meth) acrylic resin is, for example, from 30,000 to 200,000, preferably from 40,000 to 100,000, and more preferably from 50,000 to 80,000, in order to prevent color stripes, a decrease in image density, and fogging.

The weight average molecular weight of the styrene (meth)acrylic resin is a value measured by the same method as that used for measuring the molecular weight of the polyester resin.

The content of the styrene (meth)acrylic resin is, for example, from 10% by mass to 30% by mass, more preferably from 12% by mass to 28% by mass, and even more preferably from 15% by mass to 25% by mass with respect to the toner particle, in order to prevent color stripes, a decrease in image density, and fogging.

—Colorant—

The colorant is same as the colorant described in the first exemplary embodiment above.

—Release Agent—

The release agent is same as the release agent described in the first exemplary embodiment above.

—Other Additives—

Other additives are same as the other additives described in the first exemplary embodiment above.

—Characteristics of Toner Particle—

The characteristics of toner particle are same as the characteristics of toner particle described in the first exemplary embodiment above.

(External Additive)

An oil-treated particle can be used as an external additive. The oil-treated silica particle is a silica particle subjected to surface treatment with oil.

As the silica particles to be subjected to the oil treatment, silica, that is, particles having $SiO_2$ as a main component may be used and the particles may be crystalline or amorphous. In addition, the silica particles may be particles obtained by manufacturing water glass or a silicon compound such as alkoxysilane in a raw material or particles obtained by crushing quartz.

Specifically, examples of the silica particles include sol-gel silica particles, aqueous colloidal silica particles, alcohol silica particles, fumed silica particles obtained by a gas phase method, and fused silica particles.

As the oil for the surface treatment of the silica particles, one or more compounds selected from a group consisting of lubricant and fat and oil. Specifically, examples of oil include silicone oil, paraffin oil, fluorine oil, and vegetable oil. The oil may be used alone or in combination of plural kinds thereof.

Examples of silicone oil include dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy.polyether-modified silicone oil, phenol-modified silicone oil, carboxyl-modified silicone oil, mercapto-modified silicone oil, acryl/methacryl-modified silicone oil, and αmethylstyrene-modified silicone oil.

Examples of paraffin oil include liquid paraffin and the like.

Examples of fluorine oil include fluorine oil and fluorine chloride oil.

Examples of mineral oil include machine oil and the like.

Examples of vegetable oil include repeseed oil and palm oil.

Among the oil, silicone oil is preferable in order to prevent color stripes, a decrease in image density, and fogging. When silicone oil is used, the oil is easily surface-treated on the silica particles in a thin film shape approximately evenly.

The isolation oil amount of the oil-treated silica particles is from 3% by mass to 30% by mass. The isolation oil amount is more preferably from 5% by mass to 20% by mass, and more preferably from 8% by mass to 15% by mass, in order to prevent color stripes, a decrease in image density, and fogging.

By setting the isolation oil amount to be equal to or greater than 3% by mass, the toner charging amount decrease phenomenon due to oil suitably occurs. Accordingly, a decrease in image density due to charge-up is prevented. In addition, by setting the isolation oil amount to be equal to or greater than 3% by mass, lubricity of the surface of the image holding member increases and the generation of filming is prevented. Accordingly, the generation of color stripes is prevented.

Meanwhile, by setting the isolation oil amount to be equal to or smaller than 30% by mass, the isolated oil excessively attached to the surface of the toner particles is prevented (in a case of a two-component developer, the isolated oil excessively attached to the carrier is also prevented), and excessive charge leakage is prevented. Therefore, the generation of fogging due to a decrease in a charging amount is prevented.

The isolation oil amount is a ratio of the isolation oil amount with respect to the entirety of the oil-treated silica particles. The isolation oil amount is a value measured by the following method.

Measurement of Proton NMR is performed with respect to the oil-treated silica particles using AL-400 (magnetic field of 9.4 T (H nuclear of 400 MHz)) manufactured by JEOL Ltd. A zirconia-made sample tube (diameter of 5 mm) is filled with a sample, a heavy chloroform solvent, TMS as a reference substance. This sample tube is set and measurement is performed at a frequency of Δ87 kHz/400 MHz (=Δ20 ppm), measurement temperature of 25° C., integration times of 16 times, and resolution of 0.24 Hz (32,000 point), for example, and the measured value is converted into the isolation oil amount from peak intensity derived from the isolated oil using a calibration curve.

For example, when dimethyl silicone oil is used as oil, NMR measurement of untreated silica particles and dimethyl silicone oil (sprinkle approximately an amount of 5 standard), and a calibration curve of the oil isolation amount and the NMR peak intensity is created. The isolation oil amount is calculated using the calibration curve.

When increasing the isolation oil amount of the oil-treated silica particles, for example, the oil treatment is performed for multiple times. In addition, when decreasing the isolation oil amount of the oil-treated silica particles, for example, a process of immersing the particles in a solvent and drying the particles is repeatedly executed.

A treatment amount of oil of the oil-treated silica particles is preferably from 2% by mass to 30% by mass, more preferably from 5% by mass to 20% by mass, and even more preferably from 8% by mass to 15% by mass, with respect to the entire mass of the silica particles (silica particles not subjected to oil treatment), in order to prevent color stripes, a decrease in image density, and fogging.

A volume average particle diameter of the oil-treated silica particles is preferably from 15 nm to 200 nm, more preferably from 25 nm to 150 nm, and even more preferably from 30 nm to 120 nm, in order to prevent color stripes, a decrease in image density, and fogging.

By setting the volume average particle diameter of the oil-treated silica particles in the range described above, the oil-treated silica particles are suitably isolated from the toner particles, the isolated oil is easily attached to the entire surface of the image holding member, and the generation of the color stripe is prevented. In addition, isolated oil excessively attached to the surface of the toner particles is prevented, charging capability of the toner is controlled, and a decrease in image density and the generation of fogging are easily prevented.

Particularly, when a two-component developer containing a toner and a carrier is used, the isolated oil-treated silica particles suitably transit to the surface of the carrier, and accordingly, the isolated oil is easily and suitably attached to the surface of the carrier. Therefore, charging capability of the toner is controlled and a decrease in image density and the generation of fogging are easily prevented.

The volume average particle diameter of the oil-treated silica particles is a value measured by the following method.

100 primary particles of the oil-treated silica particles are observed using a scanning electron microscope (SEM). Next, the maximum diameter and the minimum diameter of each particle are measured by image analysis of the primary particles and a sphere equivalent diameter is measured from a median value thereof. A diameter when the cumulative percentage becomes 50% based on volume of the obtained sphere equivalent diameter (D50v) is set as the volume average particle diameter of the oil-treated silica particles.

The amount of the external additives externally added (added amount) is, for example, preferably from 0.5% by mass to 5.0% by mass, and more preferably from 0.8% by mass to 3.0% by mass with respect to the entire mass of the toner particles.

As the external additive, external additives other than the oil-treated silica particles may be used.

Examples of other external additives include inorganic particles such as (inorganic particles other than the oil-treated silica particles) silica, alumina, titanium oxide, barium titanate, magnesium titanate, calcium titanate, strontium titanate, zinc oxide, silica sand, mica, wollastonite, diatomaceous earth, chrome oxide, cerium oxide, rough, antimony trioxide, magnesium oxide, zirconium oxide, barium sulfate, barium carbonate, calcium carbonate, silicon carbonate, and silicon nitride. In addition, examples of other external additives also include resin particles of a fluorine resin or a silicone resin, and particles of metal salt of higher fatty acid represented by zinc stearate.

Surfaces of the inorganic particles as the other external additives may be subjected to a hydrophobizing treatment. The hydrophobizing treatment is performed by, for example, dipping the inorganic particles in a hydrophobizing agent. The hydrophobizing agent is not particularly limited and examples thereof include a slime coupling agent, a titanate coupling agent, and an aluminum coupling agent. These may be used alone or in combination of two or more kinds thereof.

The amount of the other external additives externally added (added amount) is, for example, preferably from 0.01% by mass to 5% by mass, and more preferably from 0.01% by mass to 2.0% by mass with respect to the entire mass of the toner particles.

(Toner Preparing Method)

The toner according to the second exemplary embodiment is obtained by externally adding an external additive to the toner particle after preparing of the toner particle.

The toner particles may be prepared using any of a dry preparing method (e.g., kneading and pulverizing method) and a wet preparing method (e.g., aggregation and coalescence method, suspension and polymerization method, and dissolution and suspension method). The toner particle preparing method is not particularly limited to these preparing methods, and a known preparing method is employed. Among these, the toner particles are preferably obtained by an aggregation and coalescence method.

Specifically, for example, when the toner particles are prepared by an aggregation and coalescence method, the toner particles are prepared through the processes of: preparing a polyester resin particle dispersion liquid in which polyester resin particles are dispersed (polyester resin particle dispersion liquid preparation process); preparing styrene (meth)acrylic resin particle dispersion liquid in which styrene (meth)acrylic resin particles are dispersed (styrene (meth)acrylic resin particle dispersion liquid preparation process); aggregating resin particles (if necessary, and other particles) in a mixed dispersion liquid obtained by mixing the two resin particle dispersion liquid with each other (in dispersion liquid obtained by mixing the other particle dispersion liquid such as a coloring agent, too, if necessary) and forming first aggregated particles (first aggregated particle forming process); mixing the first aggregated particle dispersion liquid in which the first aggregated particles are dispersed, and the polyester resin particle dispersion liquid with each other, performing aggregation so as to adhere the polyester resin particles to the surface of the first aggregated particles and forming the second aggregated particles (second aggregated particle forming process); and heating the second aggregated particle dispersion liquid in which the second aggregated particles are dispersed, to coalesce the second aggregated particles, and forming toner particles (coalescence process).

The preparing method of the toner particles is not limited to the preparing method described above, and the toner particles may be prepared through the processes of: heating the first aggregated particle dispersion liquid in which the first aggregated particles are dispersed, to coalesce the first aggregated particles, without performing the second aggregation process.

Hereinafter, the respective processes of the aggregation and coalescence method will be described in detail. In the following description, a method of obtaining toner particles containing a coloring agent will be described, but the coloring agent and the release agent are only used if necessary. Additives other than the coloring agent and the release agent may also be used.

—Resin Particle Dispersion liquid Preparation Process—

First, with the resin particle dispersion liquid in which the polyester resin particles to be the binder resin are dispersed, a styrene (meth)acrylic resin particle dispersion liquid in which the styrene (meth)acrylic resin particles are dispersed, a coloring agent dispersion liquid in which the coloring agent particles are dispersed, and a release agent dispersion liquid in which release agent particles are dispersed are prepared.

The polyester resin particle dispersion liquid is prepared by, for example, dispersing the polyester resin particles by a surfactant in a dispersion medium.

Examples of the dispersion medium used for the polyester resin particle dispersion include aqueous mediums.

Examples of the aqueous mediums include water such as distilled water and ion exchange water, and alcohols. These may be used alone or in combination of two or more kinds thereof.

Examples of the surfactant include anionic surfactants such as sulfuric ester salt, sulfonate, phosphate, and soap; cationic surfactants such as amine salt and quaternary ammonium salt; and nonionic surfactants such as polyethylene glycol, alkyl phenol ethylene oxide adduct, and polyol. Among these, anionic surfactants and cationic surfactants are particularly used. Nonionic surfactants may be used in combination with anionic surfactants or cationic surfactants.

The surfactants may be used alone or in combination of two or more kinds thereof.

As a method of dispersing the polyester resin particles in the dispersion medium, a common dispersing method using, for example, polyester resin particles in the dispersion medium, a common dispersing method using, for example, a rotary shearing-type homogenizer, or a ball mill, a sand mill, or a Dyno Mill having media is exemplified. In addition, the polyester resin particles may be dispersed in the dispersion medium using, for example, a phase inversion emulsification method. The phase inversion emulsification method includes: dissolving a resin to be dispersed in a hydrophobic organic solvent in which the resin is soluble; performing neutralization by adding a base to an organic continuous phase (0 phase); and performing phase inversion from W/O to O/W by adding water (W phase), thereby dispersing the resin as particles in the aqueous medium.

The volume average particle diameter of the polyester resin particles dispersed in the polyester resin particle dispersion liquid is, for example, preferably from 0.01 μm to 1 μm, more preferably from 0.08 μm to 0.8 μm, and even more preferably from 0.1 μm to 0.6 μm.

Regarding the volume average particle diameter of the polyester resin particles, a cumulative distribution by volume is drawn from the side of the smallest diameter with respect to particle size ranges (channels) separated using the particle size distribution obtained by the measurement of a laser diffraction-type particle size distribution measuring device (for example, manufactured by Horiba, Ltd., LA-700), and a particle diameter when the cumulative percentage becomes 50% with respect to the entirety of the particles is measured as a volume average particle diameter D50v. The volume average particle diameter of the particles in other dispersion liquid is also measured in the same manner.

The content of the polyester resin particles contained in the polyester resin particle dispersion liquid is, for example, preferably from 5% by mass to 50% by mass, and more preferably from 10% by mass to 40% by mass.

The styrene (meth)acrylic resin particle dispersion liquid, the coloring agent dispersion liquid, and the release agent dispersion liquid are also prepared in the same manner as in the case of the polyester resin particle dispersion liquid. That is, the polyester resin particle dispersion liquid is the same as the styrene (meth)acrylic resin particle dispersion liquid, the coloring agent dispersion liquid, and the release agent dispersion liquid, in terms of the dispersion medium, the dispersing method, the volume average particle diameter of the particles, and the content of the particles.

—First Aggregated Particle Forming Process—

Next, the polyester resin particle dispersion liquid, the styrene (meth)acrylic resin particle dispersion liquid, the coloring agent dispersion liquid, and the release agent dispersion liquid are mixed with each other.

The polyester resin particles, the styrene (meth)acrylic resin particles, the coloring agent particles, and the release agent particles heterogeneously aggregate in the mixed dispersion liquid, thereby forming first aggregated particles having a diameter near a target toner particle diameter and including the polyester resin particles, the styrene (meth) acrylic resin particles, the coloring agent particles, and the release agent particles.

Specifically, for example, an aggregating agent is added to the mixed dispersion liquid and a pH of the mixed dispersion liquid is adjusted to acidity (for example, the pH is from 2 to 5). If necessary, a dispersion stabilizer is added. Then, the mixed dispersion liquid is heated at a temperature of the glass transition temperature of the polyester resin (specifically, for example, from a temperature 30° C. lower than the glass transition temperature of the polyester resin particles to a temperature 10° C. lower than the glass transition temperature) to aggregate the particles dispersed in the mixed dispersion liquid, thereby forming the first aggregated particles.

In the first aggregated particle forming process, for example, the aggregating agent may be added at room temperature (for example, 25° C.) under stirring of the mixed dispersion liquid using a rotary shearing-type homogenizer, the pH of the mixed dispersion liquid may be adjusted to acidity (for example, the pH is from 2 to 5), a dispersion stabilizer may be added if necessary, and the heating may then be performed.

As the aggregating agent, a surfactant having an opposite polarity to the polarity of the surfactant included in the mixed dispersion liquid, for example, inorganic metal salts and di- or higher-valent metal complexes are used. When a metal complex is used as the aggregating agent, the amount of the aggregating agent used is reduced and charging characteristics are improved.

With the aggregating agent, an additive may be used to form a complex or a similar bond with the metal ions of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid; aminocarboxylic acid such as iminodiacetic acid (IDA), nitrilotriacetic acid (NTA), and ethylenediaminetetraacetic acid (EDTA).

The amount of the chelating agent added is, for example, preferably from 0.01 parts by mass to 5.0 parts by mass, and more preferably from 0.1 parts by mass to less than 3.0 parts by mass, with respect to 100 parts by mass of the resin particles.

—Second Aggregated Particle Forming Process—

After obtaining the first aggregated particle dispersion liquid in which the first aggregated particles are dispersed, the first aggregated particle dispersion liquid and the polyester resin particle dispersion liquid are mixed with each other.

In the mixed dispersion liquid in which the first aggregated particles and the polyester resin particles are dispersed, the particles are aggregated so as to adhere the polyester resin particles to the surface of the first aggregated particles, and the second aggregated particles are formed.

Specifically, for example, in the first aggregated particle forming process, when the desired particle diameter of the first aggregated particles is achieved, the dispersion liquid in which the polyester resin particles are dispersed is mixed with the first aggregated particle dispersion liquid. Then, this mixed dispersion liquid is heated at a temperature equal to or lower than the glass transition temperature of the polyester resin. By setting the pH of the mixed dispersion liquid in a range of 6.5 to 8.5, for example, the progress of the aggregation is stopped.

Accordingly, the second aggregated particles are obtained by aggregating the polyester resin particles so as to adhere the surface of the first aggregated particles.

—Coalescence Process—

Next, the second aggregated particle dispersion liquid in which the second aggregated particles are dispersed is heated at, for example, a temperature that is equal to or higher than the glass transition temperature of the polyester resin (for example, a temperature that is higher than the glass transition temperature of the polyester resin particles by 10° C. to 50° C.) to coalesce the second aggregated particles and form toner particles.

Toner particles are obtained through the foregoing processes.

After the coalescence process ends, the toner particles formed in the solution are subjected to a washing process, a solid-liquid separation process, and a drying process, that are well known, and thus dry toner particles are obtained.

In the washing process, preferably, displacement washing using ion exchange water is sufficiently performed from the viewpoint of charging properties. In addition, the solid-liquid separation process is not particularly limited, but suction filtration, pressure filtration, or the like is preferably performed from the viewpoint of productivity. The method for the drying process is also not particularly limited, but freeze drying, flash jet drying, fluidized drying, vibration-type fluidized drying, or the like is preferably performed from the viewpoint of productivity.

The toner according to the second exemplary embodiment is prepared by, for example, adding and mixing an external additive with dry toner particles that have been obtained. The mixing is preferably performed with, for example, a V-blender, a HENSCHEL mixer, a Lödige mixer, or the like. Furthermore, if necessary, coarse toner particles may be removed using a vibration sieving machine, a wind-power sieving machine, or the like.

<Electrostatic Charge Image Developer>

An electrostatic charge image developer according to this exemplary embodiment includes at least the toner according to the first exemplary embodiment or the toner according to the second exemplary embodiment.

The electrostatic charge image developer according to this exemplary embodiment may be a single-component developer including only the toner according to the first exemplary embodiment or the second exemplary embodiment, or a two-component developer obtained by mixing the toner with a carrier.

The carrier is not particularly limited, and known carriers are exemplified. Examples of the carrier include a coated carrier in which surfaces of cores formed of a magnetic powder are coated with a coating resin; a magnetic powder dispersion-type carrier in which a magnetic powder is dispersed and blended in a matrix resin; and a resin impregnation-type carrier in which a porous magnetic powder is impregnated with a resin.

The magnetic powder dispersion-type carrier and the resin impregnation-type carrier may be carriers in which constituent particles of the carrier are cores and coated with a coating resin.

Examples of the magnetic powder include magnetic metals such as iron, nickel, and cobalt, and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as a conductive particles.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (mass ratio) between the toner and the carrier in the two-component developer is preferably from 1:100 to 30:100, and more preferably from 3:100 to 20:100 (toner:carrier).

<Image Forming Apparatus/Image Forming Method>

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer as a toner image, a transfer unit that transfers the toner image formed on the surface of the image holding member onto a surface of a recording medium, a cleaning unit that has a cleaning blade cleaning the surface of the image holding member, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including a charging process of charging a surface of an image holding member, an electrostatic charge image forming process of forming an electrostatic charge image on the charged surface of the image holding member, a developing process of developing the electrostatic charge image formed on the surface of the image holding member with the electrostatic charge image developer according to this exemplary embodiment as a toner image, a transfer process of transferring the toner image formed on the surface of the image holding member onto a surface of a recording medium, a cleaning process of cleaning the surface of the image holding member by a cleaning blade, and a fixing process of fixing the toner image transferred onto the surface of the recording medium is performed.

As the image forming apparatus according to this exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; or an apparatus that is provided with an erasing unit that irradiates, after transfer of a toner image and before charging, a surface of an image holding member with erasing light for erasing.

In the case of an intermediate transfer-type apparatus, a transfer unit has, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that accommodates the electrostatic charge image developer according to this exemplary embodiment and is provided with a developing unit is preferably used.

The process cartridge may include a developer holding member for holding and supplying the electrostatic charge image developer and a container that accommodates the electrostatic charge image developer.

Hereinafter, an example of the image forming apparatus according to this exemplary embodiment will be shown. However, this image forming apparatus is not limited thereto. Major parts shown in the drawing will be described, but descriptions of other parts will be omitted.

FIG. 1 is a schematic diagram showing a configuration of the image forming apparatus according to this exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are disposed to be separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toner including four color toner, that is, a yellow toner, a magenta toner, a cyan toner, and a black toner accommodated in toner cartridges 8Y, 8M, 8C, and 8K, respectively.

The first to fourth units 10Y, 10M, 10C, and 10K have the same configuration, and accordingly, only the first unit 10Y that is disposed on the upstream side in a traveling direction of the intermediate transfer belt to form a yellow image will be representatively described herein. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that has a cleaning blade 6Y-1 removing the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by applying laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y accommodates, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the latent image part having been erased on the surface of the photoreceptor 1Y, whereby the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, whereby the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed and collected by the cleaning blade 6Y-1 of the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copiers, printers, and the like. As a recording medium, an OHP sheet is also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are preferably used.

The recording sheet P on which the fixing of the color image is completed is discharged toward a discharge part, and a series of the color image forming operations end.

<Process Cartridge/Toner Cartridge>

A process cartridge according to this exemplary embodiment will be described.

The process cartridge according to this exemplary embodiment is provided with a developing unit that accommodates the electrostatic charge image developer according to this exemplary embodiment and develops an electrostatic charge image formed on a surface of an image holding member with the electrostatic charge image developer as a toner image, and is detachable from an image forming apparatus.

The process cartridge according to this exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to this exemplary embodiment will be shown. However, this process cartridge is not limited thereto. Major parts shown in the drawing will be described, and descriptions of other parts will be omitted.

Figure 2:
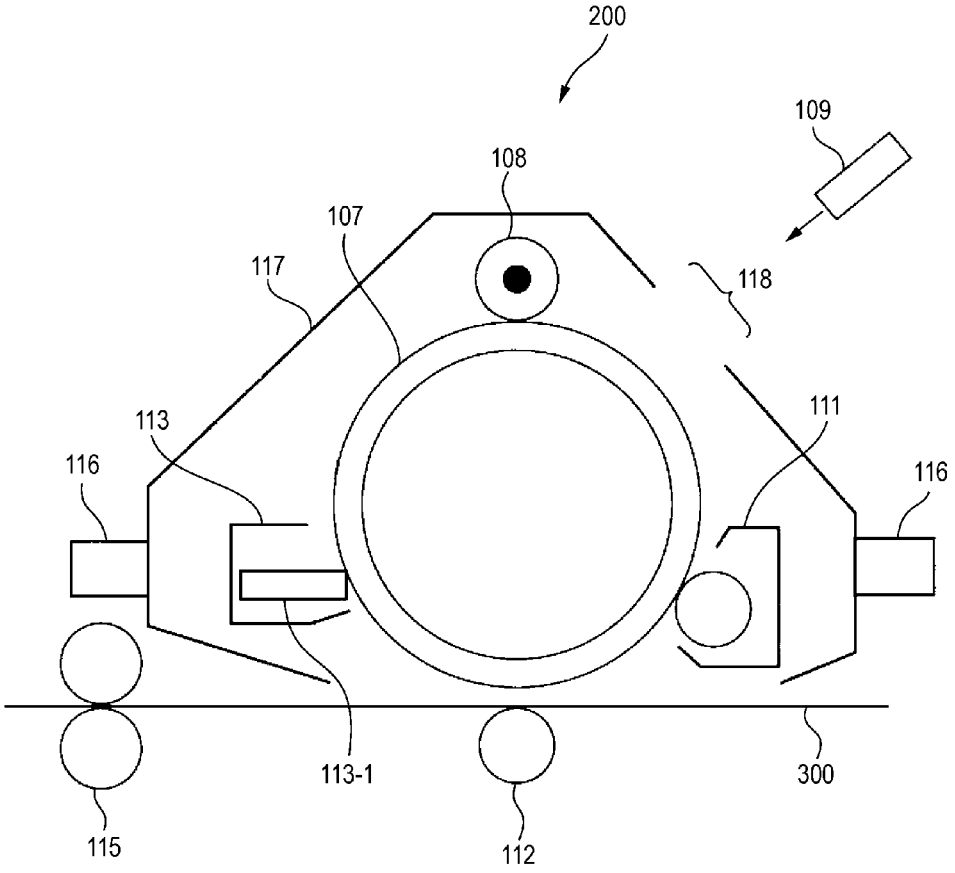
FIG. 2 is a schematic configuration diagram showing an example of a process cartridge according to the exemplary embodiment.

FIG. 2 is a schematic diagram showing a configuration of the process cartridge according to this exemplary embodiment.

A process cartridge 200 shown in FIG. 2 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit) having a cleaning blade 113-1, which are provided around the photoreceptor 107, are integrally combined and held by the use of, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to this exemplary embodiment will be described.

The toner cartridge according to this exemplary embodiment accommodates the toner according to this exemplary embodiment and is detachable from an image forming apparatus. The toner cartridge accommodates a toner for replenishment for being supplied to the developing unit provided in the image forming apparatus.

The image forming apparatus shown in FIG. 1 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, when the toner accommodated in the toner cartridge runs low, the toner cartridge is replaced.

In the image forming apparatus according to the exemplary embodiment, any of a contact-type charging device and a non-contact-type charging device may be used as the charging unit. In the exemplary embodiment, since leakage of the external additive in the cleaning portion hardly occurs as described above, charger contamination hardly occurs even when using the contact-type charging device as the charging unit and the stripe image defects are prevented.

EXAMPLES

Hereinafter, the exemplary embodiment will be more specifically described in detail using examples and comparative examples, but is not limited to these examples. In the following description, unless specifically noted, "parts" and "%" are based on mass.

<Preparation of Polyester Resin Particle Dispersion Liquid>

(Preparation of Polyester Resin Particle Dispersion Liquid (1))

2.2 mol adduct of ethylene oxide of bisphenol A: 40 parts by mol 2.2 mol adduct of propylene oxide of bisphenol A: 60 parts by mol Dimethyl terephthalate: 60 parts by mol Dimethyl fumarate: 15 parts by mol Dodecenyl succinic acid anhydride: 20 parts by mol Trimellitic acid anhydride: 5 parts by mol The above monomers except for fumaric acid and trimellitic acid anhydride, and 0.25 parts of tin dioctanoate with respect to 100 parts of total monomers are added into a reaction vessel including a stirrer, a thermometer, a capacitor, and a nitrogen gas introducing tube. Under the nitrogen gas flow, the mixture is subjected to a reaction at 235° C. for 6 hours and is cooled to 200° C., and fumaric acid and trimellitic acid anhydride are added thereto and subjected to a reaction for 1 hour. The mixture is heated to 220° C. for 5 hours, and is polymerized under a pressure of 10 kPa until a desired molecular weight is obtained, and a transparent light yellow polyester resin (1) is obtained.

Regarding the polyester resin (1), a weight-average molecular weight is 35,000, a number-average molecular weight is 8,000, and a glass transition temperature is 59° C.

Next, the obtained polyester resin (1) is dispersed using a disperser which is obtained by modifying Cavitron CD1010 (manufactured by Eurotec Ltd.) into a high temperature and high pressure type. The pH is adjusted to 8.5 with ammonia at a composition concentration ratio of 80% of ion exchange water and 20% of the polyester resin, the Cavitron is operated under the conditions of a rotation rate of a rotator of 60 Hz, pressure of 5 Kg/cm$^2$, and heating at a temperature of 140° C. by a heat exchanger, and a polyester resin dispersion liquid (solid content of 20%) is obtained.

A volume average particle diameter of the resin particles of this dispersion liquid is 130 nm. Ion exchange water is added to the dispersion liquid to adjust the solid content to 20%, and this is set as a polyester resin particle dispersion liquid (1).

(Preparation of Polyester Resin Particle Dispersion Liquid (2))

1,10-dodecanedioic acid: 50 parts by mol 1,9-nonanediol: 50 parts by mol

The above monomers are added into a reaction vessel including a stirrer, a thermometer, a capacitor, and a nitrogen gas introducing tube, the atmosphere in the reaction vessel is substituted with dry nitrogen gas, and then 0.25 parts of titanium tetrabutoxide is added to 100 parts of the above monomers. Under the nitrogen gas flow, the mixture is stirred, subjected to a reaction at 170° C. for 3 hours, and further heated to 210° C. for 1 hour, the pressure in the reaction vessel is reduced to 3 kPa, the mixture is stirred and subjected to a reaction under the reduced pressure for 13 hours, and a polyester resin (2) is obtained.

Regarding the polyester resin (2), a weight-average molecular weight is 25,000, a number-average molecular weight is 10,500, an acid value is 10.1 mgKOH/g, and a melting temperature obtained by DSC is 73.6° C.

Next, the obtained polyester resin (2) is dispersed using a disperser which is obtained by modifying Cavitron CD1010 (manufactured by Eurotec Ltd.) into a high temperature and high pressure type. The pH is adjusted to 8.5 with ammonia at a composition concentration ratio of 80% of ion exchange water and 20% of the polyester resin, the Cavitron is operated under the conditions of a rotation rate of a rotator of 60 Hz, pressure of 5 Kg/cm$^2$, and a temperature due to a heat exchanger of 140° C., and a polyester resin dispersion liquid (solid content of 20%) is obtained.

A volume average particle diameter of the resin particles of this dispersion liquid is 180 nm. Ion exchange water is added to the dispersion liquid to adjust the solid content to 20%, and this is set as a polyester resin particle dispersion liquid (2).

<Preparation of Styrene Acrylic Resin Particle Dispersion Liquid>

(Preparation of Styrene Acrylic Resin Particle Dispersion Liquid (1))

Styrene: 77 parts n-butyl acrylate: 23 parts 1,10-dodecandiol diacrylate: 0.4 parts Dodecanthiol: 0.7 parts A solution obtained by dissolving 1.0 part of an anionic surfactant (DOWFAX manufactured by The Dow Chemical Company) in 60 parts of ion exchange water is added to a mixture obtained by mixing and dissolving the above materials, and the mixture is dispersed and emulsified in a flask, and emulsion liquid is prepared.

Then, 2.9 parts of the anionic surfactant (DOWFAX manufactured by The Dow Chemical Company) is dissolved in 90 parts of ion exchange water, 30 parts of the emulsion liquid is added thereto, and 10 parts of ion exchange water in which 1.0 part of ammonium persulfate is dissolved is added thereto.

After that, the remaining emulsion liquid is added for 3 hours, nitrogen substitution in the flask is performed, the mixture is heated in oil bath to 65° C. while stirring the solution in the flask, emulsification and polymerization is continued in this state for 5 hours, and a styrene acrylic resin particle dispersion liquid (1) is obtained. If necessary, ion exchange water is added to the styrene acrylic resin particle dispersion liquid (1), and the solid content is adjusted to 32%.

A volume average particle diameter of the particles in the styrene acrylic resin particle dispersion liquid (1) is 65 nm and a number average particle diameter thereof is 60 nm.

(Preparation of Styrene Acrylic Resin Particle Dispersion Liquid (2))

A styrene acrylic resin particle dispersion liquid (2) having solid content of 32% is obtained in the same manner as in the case of the styrene acrylic resin particle dispersion liquid (1), except for changing the amount of the amount of the anionic surfactant (DOWFAX manufactured by The Dow Chemical Company) in the solution to which 30 parts of the emulsion liquid is added from 2.9 parts to 1.55 parts and changing the amount of the emulsion liquid to be added from 30 parts to 20 parts.

A volume average particle diameter of the particles in the styrene acrylic resin particle dispersion liquid (2) is 180 nm and a number average particle diameter thereof is 162 nm.

(Preparation of Styrene Acrylic Resin Particle Dispersion Liquid (3))

A styrene acrylic resin particle dispersion liquid (3) having solid content of 32% is obtained in the same manner as in the case of the styrene acrylic resin particle dispersion liquid (1), except for changing the amount of the amount of the anionic surfactant (DOWFAX manufactured by The Dow Chemical Company) in the solution to which 30 parts of the emulsion liquid is added from 2.9 parts to 3.8 parts and changing the amount of the emulsion liquid to be added from 30 parts to 40 parts.

A volume average particle diameter of the particles in the styrene acrylic resin particle dispersion liquid (3) is 55 nm and a number average particle diameter thereof is 50 nm.

(Preparation of Styrene Acrylic Resin Particle Dispersion liquid (4))

A styrene acrylic resin particle dispersion liquid (4) having solid content of 32% is obtained in the same manner as in the case of the styrene acrylic resin particle dispersion liquid (1), except for changing the amount of the amount of the anionic surfactant (DOWFAX manufactured by The Dow Chemical Company) in the solution to which 30 parts of the emulsion liquid is added from 2.9 parts to 1.4 parts and changing the amount of the emulsion liquid to be added from 30 parts to 20 parts.

A volume average particle diameter of the particles in the styrene acrylic resin particle dispersion liquid (4) is 225 nm and a number average particle diameter thereof is 202 nm.

<Adjustment of Coloring Agent Particle Dispersion Liquid>

(Preparation of Black Pigment Dispersion Liquid (1))

- Carbon black (Regal 330 manufactured by Cabot Corporation): 250 parts
- Anionic surfactant (NEOGEN SC manufactured by Dai-Ichi Kogyo Seiyaku Co., Ltd.): 33 parts (active ingredient amount: 60%, 8% with respect to the coloring agent)
- Ion exchange water: 750 parts 280 parts of ion exchange water and 33 parts of the anionic surfactant are added to a stainless steel vessel having a size that a height of a solution surface is approximately ⅓ of a height of the vessel when all of the above components are added thereto, the surfactant is sufficiently dissolved, all of the solid solution pigments are added thereto, stirred using a stirrer until there is no unwet pigments, and sufficiently subjected to defoaming. After defoaming, remaining ion exchange water is added and the obtained mixture is dispersed using a homogenizer (ULTRA TURRAX T50 manufactured by IKA Japan, K.K.) at 5,000 rotations for 10 minutes, and the mixture is stirred using a stirrer for 24 hours and subjected to defoaming. After defoaming, the mixture is dispersed again using a homogenizer at 6,000 rotations for 10 minutes, and mixture is stirred using a stirrer for 24 hours and subjected to defoaming. Then, the dispersion liquid is dispersed at the pressure of 240 MPa using a high-pressure impact type disperser ULTIMIZER (HJP30006 manufactured by SUGINO MACHINE LIMITED). The dispersion is performed to be equivalent to 25 passes by conversion from total added amount and capacity of the apparatus. The obtained dispersion liquid is kept for 72 hours to remove a precipitate, ion exchange water is added thereto to adjust the solid content concentration to 15%, and a coloring agent particle dispersion liquid (1) is obtained. A volume average particle diameter D50 of particles in the coloring agent particle dispersion liquid (1) is 135 nm.

<Preparation of Release Agent Dispersion Liquid>

(Preparation of Release Agent Dispersion Liquid (1))

- Polyethylene wax (hydrocarbon wax: product name "POLYWAX 725 (manufactured by Baker Petrolite Corporation)", melting temperature of 104° C.): 270 parts
- Anionic surfactant (NEOGEN RK manufactured by Dai-Ichi Kogyo Seiyaku Co., Ltd., active ingredient amount: 60%): 13.5 parts (3.0% with respect to release agent as the active ingredient)
- Ion exchange water: 21.6 parts The above components are mixed with each other, the release agent is dissolved at an inner solution temperature of 120° C. using a pressure discharge type homogenizer (Gaulin homogenizer manufactured by Gaulin Co., Ltd.), the mixture is dispersed at dispersion pressure of 5 MPa for 120 minutes and then at pressure of 40 MPa for 360 minutes, and cooled, and a release agent dispersion liquid (1) is obtained. A volume average particle diameter D50 of particles in the release agent dispersion liquid (1) is 225 nm. Then, ion exchange water is added to adjust the solid content concentration to be 20.0%.

(Preparation of Toner Particle (1))

- Polyester resin particle dispersion liquid (1): 700 parts
- Polyester resin particle dispersion liquid (2): 50 parts
- Styrene acrylic resin particle dispersion liquid (1): 205 parts
- Black pigment dispersion liquid (1): 133 parts
- Release agent dispersion liquid (1): 15 parts
- Ion exchange water: 600 parts
- Anionic surfactant (Dowfax 2A1 manufactured by The Dow Chemical Company): 2.9 parts After adding the above materials in a 3-liter reaction vessel including a thermometer, a pH meter, and a stirrer and adding 1.0% nitric acid at 25° C. to adjust pH to 3.0, and 100 parts of an aluminum sulfate aqueous solution having concentration of 2% is added thereto while dispersing the mixture using a homogenizer (ULTRA TURRAX T50 manufactured by IKA Japan, K.K.) at 3,000 rpm.

Since viscosity of the raw material dispersion liquid rapidly increases during dropwise addition of the aggregating agent, the dropwise addition speed is decreased when the viscosity starts to increase, to make the aggregating agent not to be biased to one portion. When the dropwise addition of the aggregating agent is completed, the mixture is further stirred for 5 minutes after increasing the rotation rate to 5,000 rpm.

After that, a stirrer and a mantle heater are installed in the reaction vessel, the temperature is raised at a rate of temperature rise of 0.2° C./min up to 40° C. and at a rate of temperature rise of 0.05° C./min up to 53° C. when the temperature is higher than 40° C., while adjusting the rotation rate of the stirrer so that the slurry is sufficiently stirred, and the particle diameters are measured using MULTISIZER II (aperture diameter of 50 μm, manufactured by Beckman Coulter K.K) for every 10 minutes. The temperature is kept when a volume average particle diameter becomes 5.0 μm, and 460 parts of the polyester resin particle dispersion liquid (1) is added thereto for 5 minutes.

In order to stop growth of the aggregated particles forming the coating layer, after keeping the mixture at 50° C. for 30 minutes, 8 parts of 20% solution of ethylenediaminetetraacetic acid (EDTA) is added to the reaction vessel, 1 mol/liter of a sodium hydroxide aqueous solution is added thereto, and pH of the raw material dispersion liquid is controlled to 9.0. After that, the temperature is increased to 90° C. at a temperature increasing rate of 1° C./min while adjusting pH to 9.0 for every 5° C., and the mixture is kept at 90° C. When a particle shape and a surface property are observed with an optical microscope and a field-emission scanning electron microscope (FE-SEM), coalescence of the particles is checked when 6 hours has elapsed, and accordingly the vessel is cooled to 30° C. with cooling water for 5 minutes.

The cooled slurry is caused to pass through nylon mesh having an aperture of 15 μm to remove coarse powder, and the toner slurry passed the mesh is filtrated with an aspirator under the reduced pressure. The solid remaining on the filter paper is pulverized with a hand as small as possible, added to ion exchange water the amount of which is 10 times of the amount of the solid at 30° C., and stirred and mixed for 30 minutes. Then, the mixture is filtrated with an aspirator under the reduced pressure, the solid remaining on the filter paper is pulverized with a hand as small as possible, added to ion exchange water the amount of which is 10 times of the amount of the solid at 30° C., stirred and mixed for 30 minutes, and filtrated with an aspirator under the reduced pressure, again, and electrical conductivity of the filtrate is measured. This operation is repeated until the electrical conductivity of the filtrate becomes 10 μS/cm or less and the solid is washed.

The washed solid is finely pulverized with a wet type and dry-type granulator (Comil), is subjected to vacuum drying in an oven at 35° C. for 36 hours, and toner particles (1) are obtained. A volume average particle diameter of the obtained toner particles (1) is 6.0

(Preparation of Toner Particles (2) to (4))

Toner particles (2) to (4) are obtained in the same manner as in the case of the toner particles (1), except for using each of the styrene acrylic resin particle dispersion liquid (2) to (4) instead of the styrene acrylic resin particle dispersion liquid (1).

All of the volume average particle diameters of the toner particles (2) to (4) are 6.0 μm.

(Preparation of Inorganic Particle (1))

A stirrer, a dripping funnel, and a thermometer are set in a glass reaction vessel, 15 parts of ethanol and 28 parts of tetraethoxysilane are added thereto and stirred at a rotation rate of 120 rpm while keeping the temperature to 35° C. Then, 30 parts of an ammonia aqueous solution having concentration of 20% is added dropwise for 5 minutes while continuing the stirring. After performing the reaction for 1 hour in this state, a supernatant is removed by centrifugation. In addition, 100 parts of toluene is added to create a suspension, hexamethyldisilazane, the amount of which is 60% by mass with respect to the solid content in the suspension is added thereto and subjected to reaction at 95° C. for 4 hours. After that, the suspension is heated, toluene is removed, the drying is performed, coarse powder is removed with a sieve having an aperture of 81 and inorganic particle (1) which is silica particle having a number average particle diameter of 90 nm is obtained.

(Preparation of Inorganic Particle (2))

A stirrer, a dripping funnel, and a thermometer are set in a glass reaction vessel, 15 parts of ethanol and 28 parts of tetraethoxysilane are added thereto and stirred at a rotation rate of 80 rpm while keeping the temperature to 35° C. Then, 30 parts of an ammonia aqueous solution having concentration of 20% is added dropwise for 5 minutes while continuing the stirring. After performing the reaction for 1 hour in this state, a supernatant is removed by centrifugation. In addition, 100 parts of toluene is added to create a suspension, hexamethyldisilazane, the amount of which is 60% by weight with respect to the solid content in the suspension is added thereto and subjected to reaction at 95° C. for 4 hours. After that, the suspension is heated, toluene is removed, the drying is performed, coarse powder is removed with a sieve having an aperture of 156 μm, and inorganic particle (2) which is silica particle having a number average particle diameter of 180 nm is obtained.

(Preparation of Inorganic Particle (3))

A stirrer, a dripping funnel, and a thermometer are set in a glass reaction vessel, 15 parts of ethanol and 28 parts of tetraethoxysilane are added thereto and stirred at a rotation rate of 140 rpm while keeping the temperature to 35° C. Then, 30 parts of an ammonia aqueous solution having concentration of 20% is added dropwise for 5 minutes while continuing the stirring. After performing the reaction for 1 hour in this state, a supernatant is removed by centrifugation. In addition, 100 parts of toluene is added to create a suspension, hexamethyldisilazane, the amount of which is 60% by weight with respect to the solid content in the suspension is added thereto and subjected to reaction at 95° C. for 4 hours. After that, the suspension is heated, toluene is removed, the drying is performed, coarse powder is removed with a sieve having an aperture of 54 μm, and inorganic particle (3) which is silica particle having a number average particle diameter of 60 nm is obtained.

(Preparation of Inorganic Particles (4))

A stirrer, a dripping funnel, and a thermometer are set in a glass reaction vessel, 15 parts of ethanol and 28 parts of tetraethoxysilane are added thereto and stirred at a rotation rate of 60 rpm while keeping the temperature to 35° C. Then, 30 parts of an ammonia aqueous solution having concentration of 20% is added dropwise for 5 minutes while continuing the stirring. After performing the reaction for 1 hour in this state, a supernatant is removed by centrifugation. In addition, 100 parts of toluene is added to create a suspension, hexamethyldisilazane, the amount of which is 60% by mass with respect to the solid content in the suspension is added thereto and subjected to reaction at 95° C. for 4 hours. After that, the suspension is heated, toluene is removed, the drying is performed, coarse powder is removed with a sieve having an aperture of 212 μm, and inorganic particle (4) which is silica particle having a number average particle diameter of 230 nm is obtained.

(Preparation of Inorganic Particle (5))

A stirrer, a dripping funnel, and a thermometer are set in a glass reaction vessel, 15 parts of ethanol and 28 parts of tetraethoxysilane are added thereto and stirred at a rotation rate of 170 rpm while keeping the temperature to 35° C. Then, 30 parts of an ammonia aqueous solution having concentration of 20% is added dropwise for 5 minutes while continuing the stirring. After performing the reaction for 1 hour in this state, a supernatant is removed by centrifugation. In addition, 100 parts of toluene is added to create a suspension, hexamethyldisilazane, the amount of which is 60% by mass with respect to the solid content in the suspension is added thereto and subjected to reaction at 95° C. for 4 hours. After that, the suspension is heated, toluene is removed, the drying is performed, coarse powder is removed with a sieve having an aperture of 24 μm, and inorganic particle (5) which is silica particle having a number average particle diameter of 30 nm is obtained.

(Preparation of Carrier (1))

After adding 500 parts of spherical magnetite particle powder having a volume average particle diameter of 0.18 μm into a HENSCHEL mixer and sufficiently stirring, 5.0 parts of a titanate coupling agent is added thereto, heated to 95° C. and mixed and stirred for 30 minutes, and spherical magnetite particles coated with the titanate coupling agent are obtained.

Then, 6.0 parts of phenol, 10 parts of 30% formalin, 500 parts of the magnetite particles, 7 parts of 25% ammonia water, and 400 parts of water are mixed and stirred in a 1-liter four-necked flask. After heating the mixture to 90° C. for 60 minutes while stirring and causing the mixture to be subjected to the reaction at the same temperature for 180 minutes, the mixture is cooled to 30° C., 500 ml of water is added thereto, a supernatant is removed, and a precipitate is washed. This is dried at 180° C. under the reduced pressure, coarse powder is removed with a sieve having an aperture of 106 μm, and core particles having an average particle diameter of 38 μm are obtained.

Then, 200 parts of toluene and 35 parts of styrene-methyl methacrylate copolymer (component mol ratio of 10:90 and weight-average molecular weight of 160,000) are stirred with a stirrer for 90 minutes, and a coating resin solution is obtained.

Next, 1,000 parts of the core particles and 70 parts of the coating resin solution are added into a vacuum deairing type kneader coater (clearance between a rotor and a wall surface of 35 mm), stirred at 30 rpm at 65° C. for 30 minutes, and further heated to 88° C., and toluene removing, deairing, and drying are performed under the reduced pressure. By sieving with mesh having an aperture of 75 μm, a carrier (1) is prepared. A shape factor SF2 of the carrier is 104.

(Preparation of Developer)

After blending 100 parts of the toner particles shown in Table 1 and 1.5 parts of the inorganic particle shown in Table 1 using a HENSCHEL mixer at a circumferential speed of 20 m/s for 15 minutes, coarse particles are removed using a sieve having an aperture of 45 μM, and a toner is obtained.

8 parts of the obtained toner and 100 parts of the carrier (1) are stirred using a V-blender at 20 rpm for 20 minutes and sieved with a sieve having an aperture of 212 μm, and accordingly, a developer is obtained.

<Measurement>

Regarding the toner of the developer obtained in each example, the number average diameter of the styrene (meth) acrylic domain ("domain diameter (nm)" in Table 1) and the number average particle diameter of the inorganic particles ("number average particle diameter (nm)" in Table 1) are measured by the above-described method. The results are shown in Table 1. The ratio of the number average diameter of the styrene (meth)acrylic domain and the number average particle diameter of the inorganic particles ("particle diameter ratio" in Table 1 and a numerical value showing that how many times of the number average particle diameter of the inorganic particles, the number average diameter of the styrene (meth)acrylic domain is equal to) is also shown in Table 1.

<Evaluation>

(Evaluation of Peeling Properties)

A developing device of remodeled "700 Digital Color Press" (printable with monochromatic colors) manufactured by Fuji Xerox Co., Ltd. is filled with the obtained developer.

After leaving the developing device in the environment of a high temperature and high humidity (temperature of 28° C. and humidity of 85%) for a day, a solid image is fixed on a front end portion and a character image is fixed on a rear end portion using Premier TCF 80 gsm paper as a recording medium (sheet) and occurrence or non-occurrence of offset is visually observed. Evaluation criteria are as follows and the results are shown in Table 1. A and B of the following evaluation criteria are in an acceptable range in practice.

A: Peeling is particularly excellent and no offset occurs in the solid image on the front end and in the character portion on the rear end.

B: No offset occurs in the solid image on the front end and in the character portion on the rear end.

C: Peeling is performed using a peeling claw and is in a level without a problem in practice.

D: Peeling at the time of fixation is not sufficient and is in a level with a problem in practice.

(Evaluation of Color Stripe)

A developing device of remodeled "700 Digital Color Press" (printable with monochromatic colors) manufactured by Fuji Xerox Co., Ltd. is filled with the obtained developer.

After leaving the developing device in the environment of a high temperature and high humidity (temperature of 28° C. and humidity of 85%) for a day, 100,000 sheets of an image having image density of 90% (high-density image) are continuously printed using Premier TCF 80 gsm paper as a recording medium (sheet), and then, 100 sheets of an image having image density of 5% (low-density image) are continuously printed. Regarding 100 sheets of the obtained low-density images, generation or non-generation of color stripes (stripe image defects) is visually observed. Evaluation criteria are as follows and the results are shown in Table 1. A, B+, B, and B− of the following evaluation criteria are in an acceptable range in practice.

A: No color stripes are generated

B+: generation of color stripes 3 sheets

B: 3 sheets <generation of color stripes 5 sheets

B−: 5 sheets <generation of color stripes 7 sheets

C: 7 sheets <generation of color stripes 10 sheets

D: generation of color stripes >10 sheets

TABLE 1

| | Toner particle | | Inorganic particle | | | Evaluation | |
|---|---|---|---|---|---|---|---|
| | Type | Domain diameter (nm) | Type | Number average particle diameter (nm) | Particle diameter ratio | Peeling properties | Color stripes |
| Example 1 | (2) | 770 | (1) | 90 | 8.56 | B | B+ |
| Example 2 | (2) | 770 | (2) | 180 | 4.28 | B | A |
| Example 3 | (1) | 320 | (2) | 180 | 1.78 | A | B |
| Example 4 | (1) | 320 | (1) | 90 | 3.56 | A | A |
| Example 5 | (2) | 770 | (4) | 230 | 3.35 | B | B+ |
| Example 6 | (1) | 320 | (3) | 60 | 5.33 | A | B+ |
| Comparative Example 1 | (2) | 770 | (3) | 60 | 12.83 | B | D |
| Comparative Example 2 | (4) | 870 | (1) | 90 | 9.67 | D | B |
| Comparative Example 3 | (1) | 320 | (4) | 230 | 1.39 | A | D |
| Comparative Example 4 | (3) | 250 | (1) | 90 | 2.78 | D | B |
| Comparative Example 5 | (3) | 250 | (5) | 30 | 8.33 | D | D |
| Comparative Example 6 | (1) | 320 | (5) | 30 | 10.67 | A | D |

From the above results, it is found that peeling properties are obtained and the stripe image defects are prevented in Examples, compared to Comparative Examples.

<Preparation of Styrene Acrylic Resin Particle Dispersion Liquid>

(Preparation of Styrene Acrylic Resin Particle Dispersion Liquid (1A))

Styrene: 77 parts n-butyl acrylate: 23 parts 1,10-dodecandiol diacrylate: 0.4 parts Dodecanthiol: 0.7 parts A solution obtained by dissolving 1.0 part of an anionic surfactant (DOWFAX manufactured by The Dow Chemical Company) in 60 parts of ion exchange water is added to a mixture obtained by mixing and dissolving the above materials, and the mixture is dispersed and emulsified in a flask, and emulsion liquid is prepared.

Then, 2.0 parts of the anionic surfactant (DOWFAX manufactured by The Dow Chemical Company) is dissolved in 90 parts of ion exchange water, 20 parts of the emulsion liquid is added thereto, and 10 parts of ion exchange water in which 1.0 part of ammonium persulfate is dissolved is added thereto.

After that, the remaining emulsion liquid is added for 3 hours, nitrogen substitution in the flask is performed, the mixture is heated in oil bath to 65° C. while stirring the solution in the flask, emulsification and polymerization is continued in this state for 5 hours, and a styrene acrylic resin particle dispersion liquid (1A) is obtained. If necessary, ion exchange water is added to the styrene acrylic resin particle dispersion liquid (1A), and the solid content is adjusted to 32%. A volume average particle diameter of the particles in the styrene acrylic resin particle dispersion liquid (1A) is 0.1 μm.

<Preparation of Toner Particle>

[Preparation of Toner Particle (1A)]

Polyester resin particle dispersion liquid (1): 700 parts

Polyester resin particle dispersion liquid (2): 50 parts

Styrene acrylic resin particle dispersion liquid (1A): 205 parts

Black pigment dispersion liquid (1): 133 parts

Release agent dispersion liquid (1): 15 parts

Ion exchange water: 600 parts

Anionic surfactant (Dowfax 2A1 manufactured by The Dow Chemical Company): 2.9 parts After adding the above materials in a 3-liter reaction vessel including a thermometer, a pH meter, and a stirrer and adding 1.0% nitric acid at 25° C. to adjust pH to 3.0, and 100 parts of an aluminum sulfate aqueous solution having concentration of 2% is added thereto while dispersing the mixture using a homogenizer (ULTRA TURRAX T50 manufactured by IKA Japan, K.K.) at 3,000 rpm.

When the addition is completed, the mixture is further stirred for 5 minutes after increasing the rotation rate to 5,000 rpm.

After that, a stirrer and a mantle heater are installed in the reaction vessel, the temperature is raised at a rate of temperature rise of 0.2° C./min up to 40° C. and at a rate of temperature rise of 0.05° C./min up to 53° C. when the temperature is higher than 40° C., and the particle diameters are measured using MULTISIZER II (aperture diameter of 50 manufactured by Beckman Coulter K.K) for every 10 minutes. The first aggregated particles are formed as described above, temperature is kept when a volume average particle diameter of the first aggregated particles becomes 5.0 μm, and 460 parts of the polyester resin particle dispersion liquid (1) is added thereto for 5 minutes.

After keeping the mixture at 50° C. for 30 minutes, 8 parts of 20% solution of ethylenediaminetetraacetic acid (EDTA) is added to the reaction vessel, 1 mol/liter of a sodium hydroxide aqueous solution is added thereto, and pH of the raw material dispersion liquid is controlled to 9.0. After that, the temperature is increased to 90° C. at a temperature increasing rate of 1° C./min while adjusting pH to 9.0 for every 5° C., and the mixture is kept at 90° C. When a particle shape and a surface property are observed with an optical microscope and a field-emission scanning electron microscope (FE-SEM), coalescence of the particles is checked when 6 hours has elapsed, and accordingly the vessel is cooled to 30° C. with cooling water for 5 minutes.

The cooled slurry is caused to pass through nylon mesh having an aperture of 15 to remove coarse powder, and the toner slurry passed the mesh is filtrated with an aspirator under the reduced pressure. The solid remaining on the filter paper is pulverized with a hand as small as possible, added to ion exchange water the amount of which is 10 times of the amount of the solid at 30° C., and stirred and mixed for 30 minutes. Then, the mixture is filtrated with an aspirator under the reduced pressure, the solid remaining on the filter paper is pulverized with a hand as small as possible, added to ion exchange water the amount of which is 10 times of the amount of the solid at 30° C., stirred and mixed for 30 minutes, and filtrated with an aspirator under the reduced pressure, again, and electrical conductivity of the filtrate is measured. This operation is repeated until the electrical conductivity of the filtrate becomes 10 μS/cm or less and the solid is washed.

The washed solid is finely pulverized with a wet type and dry-type granulator (Comil), is subjected to vacuum drying in an oven at 35° C. for 36 hours, and toner particle (1A) are obtained. A volume average particle diameter of the obtained toner particle (1A) is 6.0 μm.

[Preparation of Toner Particles (2A) and (3A)]

Toner particles (2A) and (3A) are obtained in the same manner as in the case of the toner particle (1A), except for changing the kind and number of parts (amount) of "the polyester resin particle dispersion liquid (noted as "PE dispersion liquid" in Table), the styrene (meth)acrylic resin particle dispersion liquid (noted as "StAc dispersion liquid" in Table), and the release agent dispersion liquid" according to Table 2.

[Preparation of Comparative Toner Particles (C1) and (C2)]

The comparative toner particles (C1) and (C2) are obtained in the same manner as in the case of the toner particle (1A), except for changing the kind and number of parts (amount) of "polyester resin particle dispersion liquid (noted as "PE dispersion liquid" in Table), the styrene (meth)acrylic resin particle dispersion liquid (noted as "StAc dispersion liquid" in Table), and the release agent dispersion liquid" according to Table 2.

<Preparation of Oil-Treated Silica Particle>

[Preparation of Oil-Treated Silica Particle (1)]

After mixing $SiCl_4$, hydrogen gas, and oxygen gas in a mixing chamber of a combustion burner, the mixture is burned at a temperature of 1000° C. to 3000° C. Silica particles are obtained by extracting silica powder from the gas after the combustion. At that time, by setting a molar ratio of the hydrogen gas and the oxygen gas to 1.38:1, silica particles (R1) having a volume average particle diameter (D50v) of 65 nm is obtained.

100 parts of the silica particles (R1) and 500 parts of ethanol are put in an evaporator and stirred for 15 minutes while maintaining the temperature at 40° C. Then, 10 parts of dimethyl silicone oil is added to 100 parts of the silica particles and stirred for 15 minutes, and 10 parts of dimethyl silicone oil is further added to 100 parts of the silica particles and stirred for 15 minutes. Finally, the temperature is increased to 90° C. and ethanol is dried in the reduced pressure. After that, the treated material is extracted and vacuum drying is further performed at 120° C. for 30 minutes, and accordingly, oil-treated silica particle (1) having a volume average particle diameter (D50v) of 65 nm and an isolation oil amount of 12.2% by mass is obtained.

[Preparation of Oil-Treated Silica Particle (2)]

100 parts of the silica particles (R1) and 500 parts of ethanol used in the preparation of the oil-treated silica particle (1) are put in an evaporator and stirred for 15 minutes while maintaining the temperature at 40° C. Then, 5 parts of dimethyl silicone oil is added to 100 parts of the silica particles and stirred for 15 minutes, and 5 parts of dimethyl silicone oil is further added to 100 parts of the silica particles and stirred for 15 minutes. Finally, the temperature is increased to 90° C. and ethanol is dried in the reduced pressure. After that, the treated material is extracted and vacuum drying is further performed at 120° C. for 30 minutes, and accordingly, oil-treated silica particle (2) having a volume average particle diameter (D50v) of 65 nm and an isolation oil amount of 3.6% by mass is obtained.

[Preparation of Oil-Treated Silica Particle (3)]

100 parts of the silica particles (R1) and 500 parts of ethanol used in the preparation of the oil-treated silica particle (1) are put in an evaporator and stirred for 15 minutes while maintaining the temperature at 40° C. Then, 15 parts of dimethyl silicone oil is added to 100 parts of the silica particles and stirred for 15 minutes, and 25 parts of dimethyl silicone oil is further added to 100 parts of the silica particles and stirred for 15 minutes. Finally, the temperature is increased to 90° C. and ethanol is dried in the reduced pressure. After that, the treated material is extracted and vacuum drying is further performed at 120° C. for 30 minutes, and accordingly, oil-treated silica particle (3) having a volume average particle diameter (D50v) of 65 nm and an isolation oil amount of 27.7% by mass is obtained.

[Preparation of Oil-Treated Silica Particle (4)]

Oil-treated silica particle (4) having a volume average particle diameter (D50v) of 140 nm and an isolation oil amount of 12.2% by mass is obtained under the same conditions and by the same method as in the preparation of the oil-treated silica particle (1), except for setting a molar ratio of the hydrogen gas and the nitrogen gas to 1.3:1.

[Preparation of Oil-Treated Silica Particle (5)]

Oil-treated silica particle (5) having a volume average particle diameter (D50v) of 30 nm and an isolation oil amount of 12.2% by mass is obtained under the same conditions and by the same method as in the preparation of the oil-treated silica particle (1), except for setting a molar ratio of the hydrogen gas and the nitrogen gas to 1.5:1.

[Preparation of Comparative Oil-Treated Silica Particle (C1)]

100 parts of the silica particle (R1) and 500 parts of ethanol used in the preparation of the oil-treated silica particle (1) are put in an evaporator and stirred for 15 minutes while maintaining the temperature at 40° C. Then, 10 parts of dimethyl silicone oil is added to 100 parts of the silica particles and stirred for 15 minutes. Finally, the temperature is increased to 90° C. and ethanol is dried in the reduced pressure. After that, the treated material is extracted and vacuum drying is further performed at 120° C. for 30 minutes, and accordingly, comparative oil-treated silica particle (C1) having a volume average particle diameter (D50v) of 65 nm and an isolation oil amount of 1.2% by mass is obtained.

[Preparation of Comparative Oil-Treated Silica Particle (C2)]

100 parts of the silica particle (R1) and 500 parts of ethanol used in the preparation of the oil-treated silica particle (1) are put in an evaporator and stirred for 15 minutes while maintaining the temperature at 40° C. Then, 20 parts of dimethyl silicone oil is added to 100 parts of the silica particles and stirred for 15 minutes, and 30 parts of dimethyl silicone oil is further added to 100 parts of the silica particles and stirred for 15 minutes. Finally, the temperature is increased to 90° C. and ethanol is dried in the reduced pressure. After that, the treated material is extracted and vacuum drying is further performed at 120° C. for 30 minutes, and accordingly, comparative oil-treated silica particle (C2) having a volume average particle diameter (D50v) of 65 nm and an isolation oil amount of 32.1% by mass is obtained.

Examples 1A to 7A and Comparative Examples 1A to 8A

Preparation of Toner 100 parts of toner particle, kind of which is shown in Table 3, and oil-treated silica particle, kind and the parts of which are shown in Table 3 are mixed using a HENSCHEL mixer (peripheral speed of 30 m/s, 3 minutes), and each toner is obtained.

[Preparation of Developer]

Ferrite particles (average particle diameter of 50 μm): 100 parts

Toluene: 14 parts

Styrene-methyl methacrylate copolymer (copolymerization ratio: 15/85): 3 parts

Carbon black: 0.2 parts

Dispersion liquid is prepared by dispersing the above components excluding the ferrite particles with a sand mill, and this dispersion liquid is put into a vacuum deaeration kneader with the ferrite particles, pressure is reduced and drying is performed while stirring, and accordingly, a carrier is obtained.

8 parts of each toner is mixed with 100 parts of the carrier and a developer is obtained.

<Measurement>

Regarding the toner particles of the developer obtained in each example, the "presence ratio of the release agent" is measured by the above-described method. In addition, regarding the styrene acrylic resin (noted as "StAc resin" in Table), the "average diameter of the domain" and the "number ratio of the domains having diameter in a range of the average diameter ±100 nm (noted as "number ratio of domains with average diameter ±100 nm" in Table)" are measured by the above-described method. Results are shown in Table 3.

<Evaluation>

A developing device of an evaluation apparatus "700 DCP (manufactured by Fuji Xerox Co., Ltd.) is filled with the developer obtained in each example. The following evaluation is performed using this evaluation apparatus.

(Evaluation of Color Stripes)

After leaving the evaluation apparatus in the environment of a high temperature and high humidity (temperature of 28° C. and humidity of 85%) for a day, 100,000 A4-sized sheets of an image having image density of 1% are printed. Regarding the images printed on 100 sheets which are between the printed 99,000-th sheet and 100,000-th sheet, an occurrence state of color stripes is visually observed and evaluated based on the following evaluation criteria.

—Evaluation Criteria—

G1: no color stripes generated

G2: number of sheets where color stripes are generated ≤5

G3: number of sheets where color stripes are generated ≤10

G4: number of sheets where color stripes are generated >10

(Evaluation of Image Density)

After leaving the evaluation apparatus in the environment of a high temperature and high humidity (temperature of 28° C. and humidity of 85%) for a day, 100,000 A4-sized sheets of an image having image density of 1% are printed. The image density (density 1) of the first printed image and the image density (density 2) of the 100,000-th printed image are respectively measured using an image densitometer X-Rite 938 (manufactured by X-Rite, Inc.) to acquire a difference in density: Δ density=|density 1−density 2|, and evaluation is performed based on the following evaluation criteria.

—Evaluation Criteria—

G1: 0.00<Δ density ≤0.15

G2: 0.15<Δ density ≤0.25

G3: 0.25<Δ density ≤0.35

G4: 0.35>Δ density

—Evaluation Criteria—

G1: fogging density is less than 0.2 and partial fogging is not visually recognized.

G2: fogging density is less than 0.2 but slight fogging is visually recognized.

G3: fogging density is less than 0.2 but partial fogging is visually recognized.

G4: fogging density is equal to or more than 0.2

TABLE 2

| | Dispersion liquid for forming first aggregated particles | | |
|---|---|---|---|
| | PE dispersion liquid Kind/parts | StAc dispersion liquid Kind/parts | Release agent dispersion liquid Kind/parts |
| Toner (1A) | (1)/700 (2)/50 | (1A)/205 | (1)/15 |
| Toner (2A) | (1)/700 (2)/50 | (1A)/280 | (1)/15 |
| Toner (3A) | (1)/700 (2)/50 | (1A)/160 | (1)/15 |
| Comparative Toner (C1) | (1)/700 (2)/50 | (1A)/360 | (1)/15 |
| Comparative Toner (C2) | (1)/700 (2)/50 | (1A)/140 | (1)/15 |

TABLE 3

| | Toner particle | | | | | | | | |
|---|---|---|---|---|---|---|---|---|---|
| | StAc resin | | | Oil-treated silica particle | | | Evaluation | | |
| | No. | average diameter of the domain [μm] | number ratio of the domains having diameter in a range of the average diameter ± 100 nm [%] | No. | Isolation oil amount (%) | D50v (μm) | Color stripes | Image density | Fogging |
| Example 1A | (1A) | 480 | 75 | (1) | 12.2 | 65 | G1 | G1 | G1 |
| Example 2A | (2A) | 340 | 68 | (2) | 3.6 | 65 | G1 | G2 | G1 |
| Example 3A | (2A) | 340 | 68 | (3) | 27.7 | 65 | G1 | G1 | G2 |
| Example 4A | (3A) | 770 | 83 | (2) | 3.6 | 65 | G2 | G1 | G1 |
| Example 5A | (3A) | 770 | 83 | (3) | 27.7 | 65 | G2 | G1 | G2 |
| Example 6A | (1A) | 480 | 75 | (4) | 12.2 | 140 | G2 | G1 | G1 |
| Example 7A | (1A) | 480 | 75 | (5) | 12.2 | 30 | G1 | G1 | G2 |
| Comparative Example 1A | (2A) | 340 | 68 | (Cl) | 1.2 | 65 | G1 | G3 | G1 |
| Comparative Example 2A | (C1) | 220 | 48 | (2) | 3.6 | 65 | G1 | G4 | G1 |
| Comparative Example 3A | (C1) | 220 | 48 | (3) | 27.7 | 65 | G1 | G2 | G3 |
| Comparative Example 4A | (2A) | 340 | 68 | (C2) | 32.1 | 65 | G1 | G1 | G4 |
| Comparative Example 5A | (3A) | 770 | 83 | (C1) | 1.2 | 65 | G3 | G2 | G1 |
| Comparative Example 6A | (C2) | 850 | 90 | (2) | 3.6 | 65 | G4 | G2 | G2 |
| Comparative Example 7A | (C2) | 850 | 90 | (3) | 27.7 | 65 | G4 | G1 | G3 |
| Comparative Example 8A | (3A) | 770 | 83 | (C2) | 32.1 | 65 | G2 | G1 | G4 |

(Evaluation of Fogging)

After leaving the evaluation apparatus in the environment of a high temperature and high humidity (temperature of 28° C. and humidity of 85%) for a day, 100,000 A4-sized sheets of an image having image density of 40% are printed. Then, after leaving the evaluation apparatus in the environment of a high temperature and high humidity (temperature of 28° C. and humidity of 85%) for three days, 1 A4-sized sheet of an image having image density of 1% is printed. Regarding fogging (fogging of a background portion) of the first printed image, the density is measured using an image densitometer X-Rite 938 (manufactured by X-Rite, Inc.) and evaluation is performed based on the following evaluation criteria.

From the above results, it is found that the generation of color stripes, a decrease in image density, and the generation of fogging are prevented in Examples, compared to Comparative Examples.

What is claimed is:

1. An electrostatic-image-developing toner comprising:

a toner particle which contains a binder resin containing a polyester resin, a release agent, and a styrene (meth) acrylic resin and in which the styrene (meth)acrylic resin forms a domain having a number average diameter of 300 nm to 800 nm in the toner particle; and an inorganic particle in which the number average diameter of the domain is from 1.5 times to 10 times the number average particle diameter of the inorganic particle.

2. The electrostatic-image-developing toner according to claim 1, wherein the number average particle diameter of the inorganic particle is from 15 nm to 200 nm.

3. The electrostatic-image-developing toner according to claim 1, wherein the inorganic particle is an oil-treated silica particle having an oil isolation amount of 3% by mass to 30% by mass.

4. The electrostatic-image-developing toner according to claim 1, wherein a number rate of the domains contained in a range of an average diameter of ±100 nm among the domains of the styrene (meth)acrylic resin is equal to or greater than 65%.

5. The electrostatic-image-developing toner according to claim 1, wherein a glass transition temperature of the polyester resin is from 50° C. to 65° C.

6. The electrostatic-image-developing toner according to claim 1, wherein a content of the styrene (meth)acrylic resin is from 10% by mass to 30% by mass.

7. The electrostatic-image-developing toner according to claim 1, wherein a melting temperature of the release agent is from 60° C. to 100° C.

8. The electrostatic-image-developing toner according to claim 1, wherein a volume average particle diameter of the toner particles is from 4 μm to 8 μm.

9. The electrostatic-image-developing toner according to claim 1, wherein a shape factor SF1 of the toner particle is from 120 to 140.

10. An electrostatic image developer comprising:

the electrostatic-image-developing toner according to claim 1.

11. A toner cartridge which accommodates the electrostatic-image-developing toner according to claim 1, and is detachable from an image forming apparatus.

* * * * *